US007013878B1

(12) United States Patent
Cotton et al.

(10) Patent No.: US 7,013,878 B1
(45) Date of Patent: Mar. 21, 2006

(54) FUEL VAPOR SEPARATOR

(75) Inventors: Kenneth J. Cotton, Caro, MI (US); Eric L. King, Caro, MI (US); Roger N. Smith, Ubly, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 0 days.

(21) Appl. No.: 10/860,041

(22) Filed: Jun. 3, 2004

(51) Int. Cl.
*F02M 33/02* (2006.01)

(52) U.S. Cl. ..... 123/518; 123/41.31

(58) Field of Classification Search ..... 123/518, 123/516, 509, 541, 41.31
See application file for complete search history.

(56) References Cited

U.S. PATENT DOCUMENTS 3,683,597 A * 8/1972 Beveridge et al. ..... 123/519
4,768,492 A 9/1988 Widmer et al.
4,809,666 A 3/1989 Baltz
4,848,283 A 7/1989 Garms et al.
4,856,483 A 8/1989 Beavis et al.
4,989,568 A 2/1991 Sougawa
5,024,188 A 6/1991 Hartke et al.
5,073,133 A 12/1991 Inoue
5,103,793 A 4/1992 Riese et al.
5,103,877 A * 4/1992 Sherwood et al. ..... 141/59
5,115,784 A 5/1992 Mito et al.
5,119,790 A 6/1992 Olson
5,137,002 A 8/1992 Mahoney et al.
5,138,984 A 8/1992 Takashima
5,203,306 A 4/1993 Billingsley et al.
5,309,885 A 5/1994 Rawlings et al.
5,368,001 A 11/1994 Roche
5,375,578 A 12/1994 Kato et al.
5,389,245 A 2/1995 Jaeger et al.
5,392,750 A 2/1995 Laue et al.
5,404,858 A 4/1995 Kato
5,579,740 A 12/1996 Cotton et al.
5,598,827 A 2/1997 Kato
5,647,331 A 7/1997 Swanson
5,653,103 A 8/1997 Katoh
5,669,358 A 9/1997 Osakabe
5,797,378 A 8/1998 Kato
5,816,209 A 10/1998 Kato
5,819,711 A 10/1998 Motose
5,832,903 A 11/1998 White et al.
5,855,197 A 1/1999 Kato
5,865,160 A 2/1999 Kato
5,873,347 A 2/1999 Kato et al.
5,884,604 A 3/1999 Kato
5,890,472 A 4/1999 Saito
5,894,831 A 4/1999 Takahashi et al.

(Continued)

*Primary Examiner*—Mahmoud Gimie
(74) *Attorney, Agent, or Firm*—Reising, Ethington, Barnes, Kisselle, P.C.

(57) ABSTRACT

A fuel vapor separator includes a polymeric body that preferably has a polymeric canister and a polymeric lid secured to the canister to define a liquid tight enclosure. The enclosure is preferably divided into at least two chambers. One chamber preferably receives liquid fuel and communicates with a heat exchanger to cool the supply of liquid fuel therein. Vapor is trapped in a vapor dome area above the liquid fuel and is vented through a vent valve carried by the fuel vapor separator. The other chamber of the enclosure preferably receives a high pressure fuel pump adapted to receive liquid fuel from the first chamber, and to deliver liquid fuel under pressure to the engine. Preferably, the chamber in which the fuel pump is received is communicated with a coolant to facilitate cooling the fuel pump in use.

57 Claims, 13 Drawing Sheets

U.S. PATENT DOCUMENTS 5,913,294 A 6/1999 Takahashi et al.
5,915,363 A 6/1999 Iwata et al.
5,924,409 A 7/1999 Kato
5,964,206 A * 10/1999 White et al. ..... 123/541
5,996,561 A 12/1999 Watanabe
6,006,705 A 12/1999 Kato et al.
6,009,859 A 1/2000 Roche et al.
6,012,434 A 1/2000 Hartke et al.
6,032,638 A 3/2000 Kato
6,035,830 A 3/2000 Saito
6,067,966 A 5/2000 Saito et al.
6,076,509 A 6/2000 Kyuma
6,093,067 A 7/2000 Itoh et al.
6,135,100 A 10/2000 Katoh
6,149,477 A 11/2000 Toyama
6,170,470 B1 1/2001 Clarkson et al.
6,216,672 B1 4/2001 Mishima et al.
6,220,217 B1 4/2001 Kato
6,250,287 B1 6/2001 Wickman et al.
6,253,742 B1 7/2001 Wickman et al.
6,257,208 B1 7/2001 Harvey
6,279,546 B1 8/2001 Nakase et al.
6,308,695 B1 10/2001 Watanabe et al.
6,318,344 B1 11/2001 Lucier et al.
6,321,711 B1 11/2001 Kato
6,322,410 B1 11/2001 Harvey
6,346,018 B1 2/2002 Watanabe
6,367,451 B1 4/2002 Kato
6,415,773 B1 7/2002 Katayama et al.
6,422,207 B1 7/2002 Kolb et al.
6,422,255 B1 7/2002 Hartke et al.
6,428,375 B1 8/2002 Takayanagi
6,431,199 B1 8/2002 Kolb et al.
6,435,161 B1 8/2002 Kato
6,453,877 B1 9/2002 Lucier et al.
6,553,974 B1 4/2003 Wickman et al.
6,575,145 B1 6/2003 Takahashi
6,581,579 B1 * 6/2003 Knight et al. ..... 123/516
6,662,786 B1 12/2003 Watanabe
6,857,419 B1 * 2/2005 Harvey et al. ..... 123/509

* cited by examiner

FUEL VAPOR SEPARATOR

FIELD OF THE INVENTION

The present invention relates generally to fuel systems for internal combustion engines, and more particularly to a fuel vapor separator in such a fuel system.

BACKGROUND OF THE INVENTION

Some combustion engines include a fuel pump assembly having a high pressure fuel pump that delivers fuel under pressure to the engine, and a fuel vapor separator that acts as a fuel reservoir for supplying fuel to the high pressure fuel pump. The fuel pump delivers fuel to a fuel rail and associated fuel injectors. A fuel pressure regulator controls the fuel pressure within the rail and may be mounted on the return or downstream end of the rail with an exhaust or outlet of the fuel pressure regulator communicating with the fuel vapor separator through a fuel return line.

The interior volume of the fuel vapor separator is generally held at a substantially lower pressure than the fuel rail. In addition, the fuel returned to the fuel vapor separator is often heated having been routed near the engine through the fuel rail, and having also been heated by the fuel pump prior to delivery to the fuel rail. Accordingly, fuel vapor is generated when the heated return fuel is discharged into the cooler bulk fuel within the fuel vapor separator. It is desirable to prevent or at least greatly reduce the amount of fuel vapor that is drawn in by the fuel pump and delivered to downstream components to prevent or reduce the possibility of vapor lock, or reduced engine performance and efficiency.

Conventional fuel vapor separators are formed with metal bodies that require extensive machining and subsequent coating or plating to reduce corrosion from both the fuel contained therein and a coolant used to cool the fuel in the separator, which may be water including salt water in some applications. The metal bodies tend to be heavy and expensive to manufacture. Further, conventional fuel vapor separators use a float controlled vent valve assembly to vent vapor from the separator which can become stuck in their closed position and allow higher than desired pressure to build in the vapor separator. Also, water or coolant passages machined in the metal bodies can become plugged with debris in or carried by the coolant and debris resulting from corrosion of the water passage itself.

SUMMARY OF THE INVENTION

A fuel vapor separator includes a polymeric body that preferably has a polymeric canister and a polymeric lid secured to the canister to define a liquid tight enclosure. The enclosure is preferably divided into at least two chambers. One chamber preferably receives liquid fuel and communicates with a heat exchanger to cool the supply of liquid fuel therein. Vapor is trapped in a vapor dome area above the liquid fuel and is vented through a vent valve carried by the fuel vapor separator. The other chamber of the enclosure preferably receives a high pressure fuel pump adapted to receive liquid fuel from the first chamber, and to deliver liquid fuel under pressure to the engine. Preferably, the chamber in which the fuel pump is received is communicated with a coolant to facilitate cooling the fuel pump in use.

Objects, features and advantages of the presently preferred embodiments of the fuel vapor separator include providing a polymeric body for a fuel vapor separator that reduces or eliminates the need to machine, plate, coat or otherwise treat the body, provides reliable venting and internal pressure control in the fuel vapor separator, provides an improved water passage and coolant flow arrangement, resists plugging of the coolant flow passage, provides improved hot fuel handling and vapor handling, significantly reduces or eliminates fuel foaming, is of relatively compact design, can be mounted in different locations relative to an engine, is light weight, corrosion proof and of relatively simple design and economical manufacture and assembly.

BRIEF DESCRIPTION OF THE DRAWINGS

These and other objects, features and advantages of the present invention will be apparent from the following detailed description of the preferred embodiments and best mode, appended claims and accompanying drawings in which:

DETAILED DESCRIPTION OF THE PREFERRED EMBODIMENTS

Figure 1:
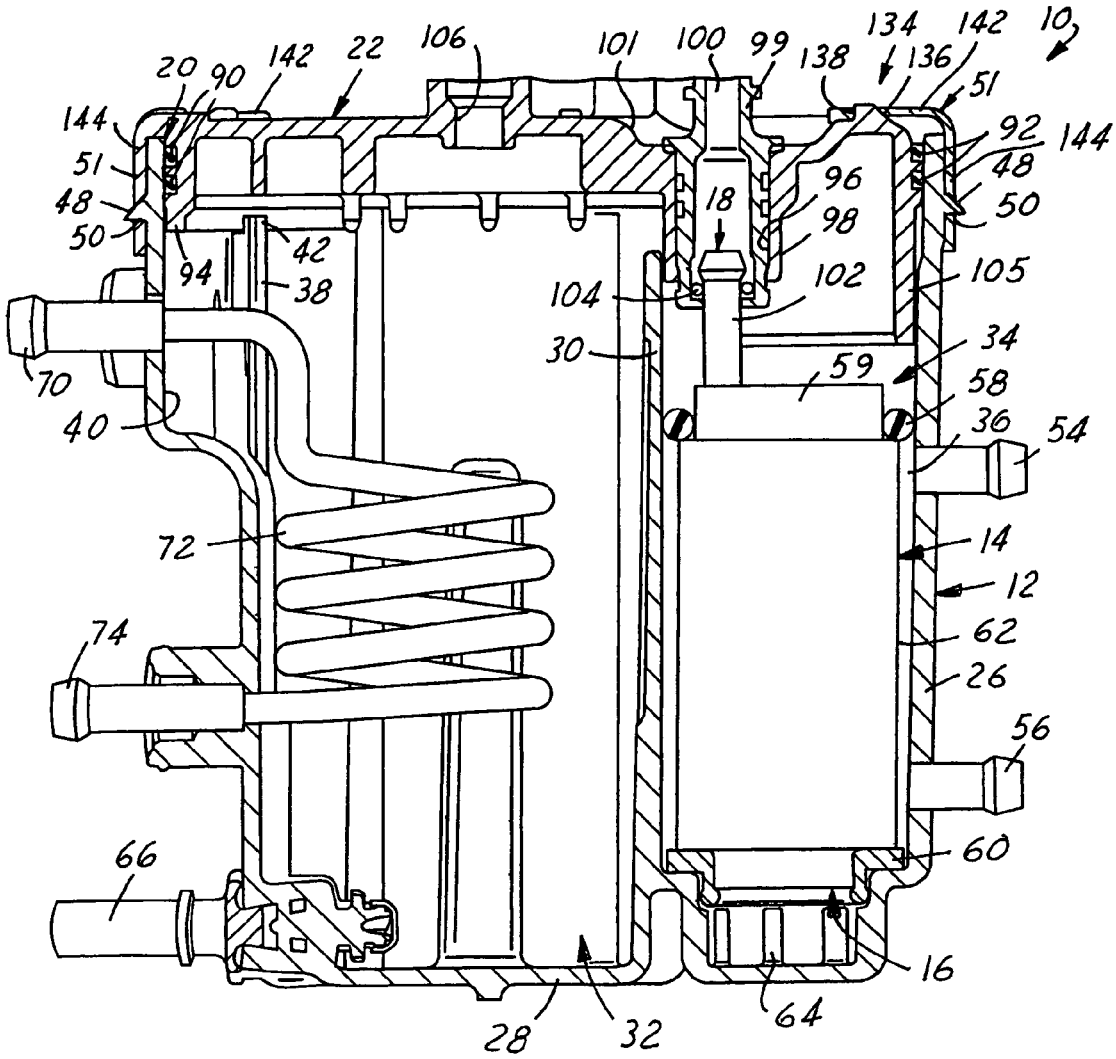
FIG. 1 is a cross-sectional view of one presently preferred embodiment of a fuel vapor separator.

Referring in more detail to the drawings, FIG. 1 illustrates a fuel vapor separator 10 having a main body 12 formed of a polymeric material that is adapted to receive a supply of liquid fuel and provide a substantially vapor free supply of liquid fuel to the inlet of a fuel pump 14. The fuel pump 14 is preferably carried by the fuel vapor separator 10 and may be an electric motor driven fuel pump having an inlet 16 in communication with the supply of liquid fuel in the main body 12 and an outlet 18 through which pressurized fuel is discharged for delivery to an engine. Desirably, the main body 12 is generally bowl shaped and has an open upper end 20 that may be closed by a suitable lid 22 that is preferably also formed of a polymeric material. The lid 22 preferably carries a vapor vent valve 24 (FIG. 9) to facilitate venting fuel vapors from the fuel vapor separator 10 and to control the internal pressure of the fuel vapor separator 10.

Figure 2:
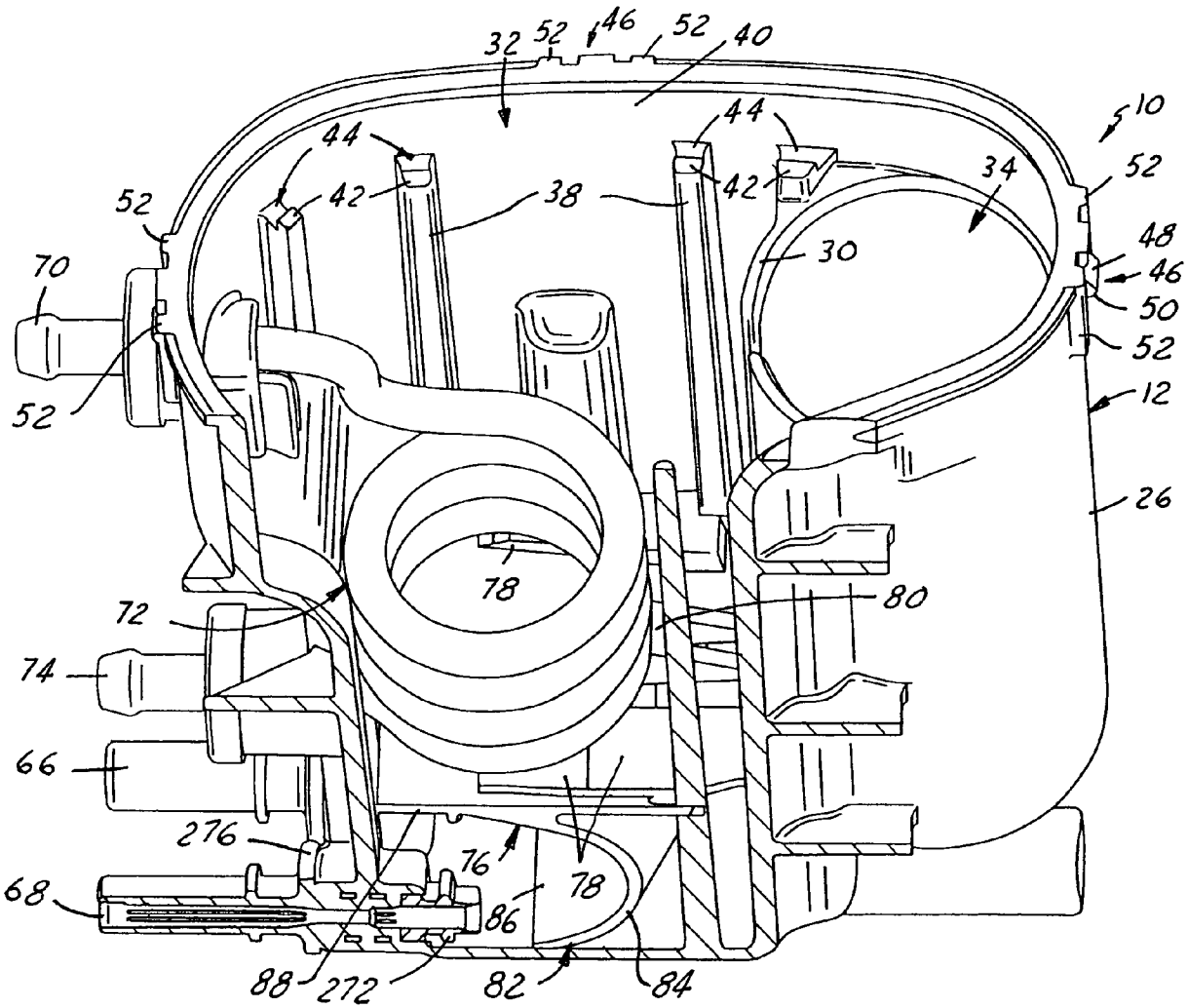
FIG. 2 is a perspective view with a portion cutaway of a main body of the fuel vapor separator of FIG. 1.
Figure 4:
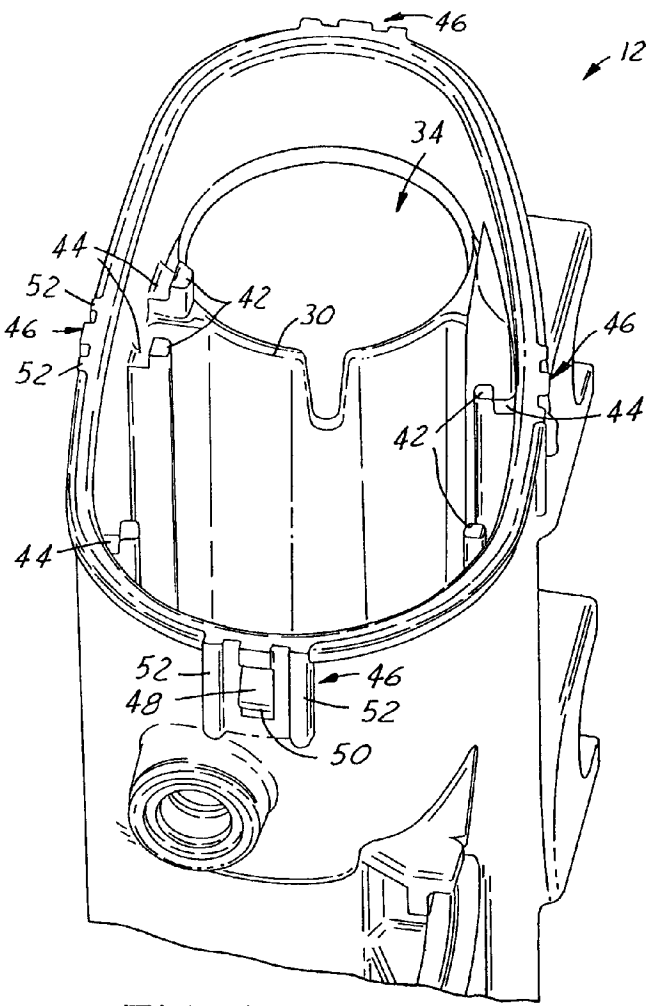
FIG. 4 is a fragmentary perspective view of the main body of the fuel vapor separator.
Figure 3:
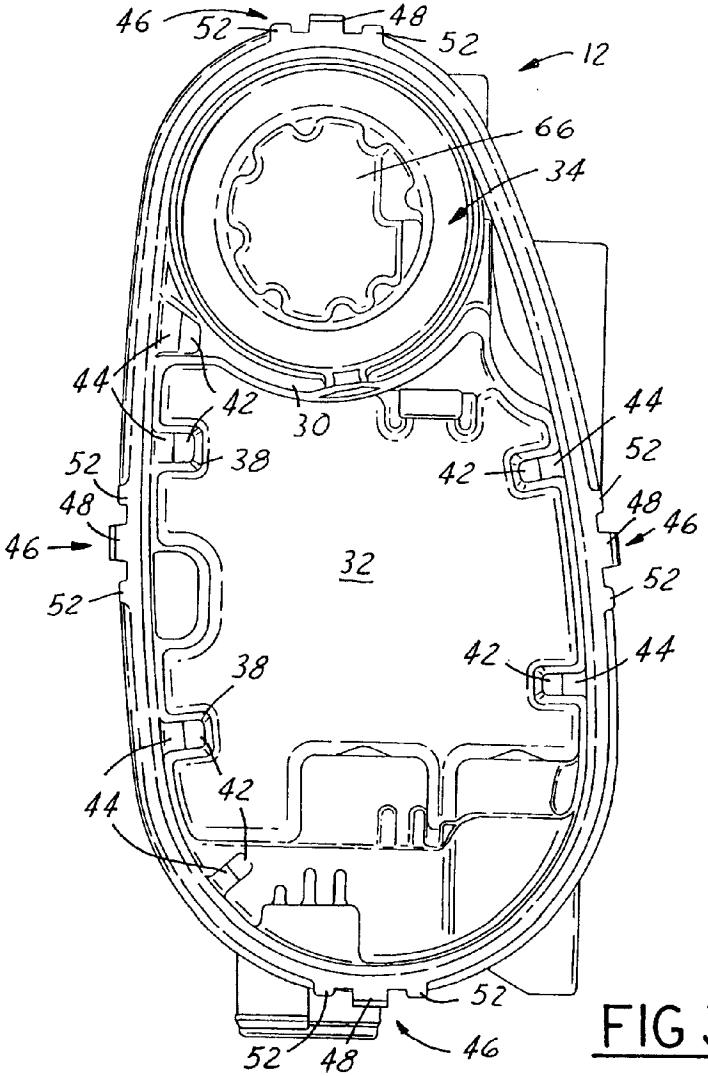
FIG. 3 is a plan view of the main body of the fuel vapor separator.

In more detail, the main body 12 of the fuel vapor separator preferably includes a circumferentially continuous side wall 26 that may be generally cylindrical, or of any desired shape or size. One end of the side wall 26 is preferably closed by a bottom wall 28 that is preferably integrally formed with the side wall 26. To facilitate receiving the fuel pump 14 among other components within the fuel vapor separator 10, the other end 20 of the main body 12 is preferably open. The main body 12 is preferably formed of a polymeric material that is resistant to degradation or dimensional changes, such as swelling, in volatile fuels. A representative, but not all inclusive or limiting, list of materials for the main body 12 includes polyamides (one example is Nylon), polyphthalimides (one example is Amodel), Acetal, and the like, each of which can be glass filled if desired. The main body 12 preferably includes an interior wall 30 that separates a main fuel chamber 32 from a second chamber 34 in which the fuel pump 14 is received. As best shown in FIGS. 2–4, the interior wall 30 may be arcuate or curved, and may be shaped generally complementary to the outer surface of the fuel pump 14, preferably with a gap 36 between the interior wall 30 and the fuel pump 14. As best shown in FIGS. 2–4, vertically extending ribs 38 may be provided along an interior surface 40 of the main body 12 to increase the rigidity and strength of the main body 12. Each rib 38 may terminate at an upstanding finger 42 separated from the interior surface 40 of the main body 12 and defined in part by a recess 44 in the rib 38.

A plurality of latch surfaces 46 are preferably provided spaced about the periphery of the open end 20 of the main body 12. Each latch surface 46 preferably has a ramp 48 and a catch surface 50. Each latch surface 46 is adapted to receive a portion of a retaining clip 51 as will be discussed in more detail below. To prevent lateral movement of a retaining clip, a pair of rails 52 preferably are provided for each latch surface 46 with one rail 52 adjacent each side of each latch 46.

The main body 12 preferably includes a coolant inlet 56 through which a supply of a coolant, such as water, is communicated with the second chamber 34, and a coolant outlet 54 through which the second chamber 34 is communicated with the exterior of the fuel vapor separator 10 to permit coolant to be discharged from the second chamber 34. The coolant preferably flows in the gap 36 between the fuel pump 14 and the interior wall 30 of the main body 12, and thus flows around the exterior of the fuel pump 14 to cool the fuel pump in use. When coolant is circulated around the fuel pump 14 in this manner, seals must be provided to present coolant from leaking into the fuel in the separator 10. As best shown in FIG. 1, an O-ring 58 or other seal may be disposed generally adjacent to an outlet end cap 59 of the fuel pump 14, and a second preferably elastomeric seal 60 may be disposed adjacent to the inlet 16 of the fuel pump 14. The seals 58, 60 preferably also provide some vibration dampening and help to radially and/or axially align the fuel pump 14 within the second chamber 34. Accordingly, a coolant chamber 62 is defined between the seals 58, 60 and surrounding a portion of the fuel pump 14.

Outside of the coolant chamber 62, the second chamber 34 may be open to the main fuel chamber 32 to permit fuel flow between them. For example, some fuel pumps 14 include an over pressure relief valve in or adjacent to the outlet end cap 59, and any fuel or fuel vapor which is discharged from this valve is preferably maintained separate from the coolant chamber 62, and may be discharged into the main fuel chamber 32. The main body 12 preferably includes a cavity 64 that is communicated with the main fuel chamber 32, preferably near the lower end of the main fuel chamber 32 to ensure that liquid fuel in the main fuel chamber 32 is communicated with the cavity 64. The cavity 64 is open to and may be formed as part of the second chamber 34 to provide liquid fuel to the inlet 16 of the fuel pump 14.

As best shown in FIGS. 1 and 2, the main body 12 preferably includes two inlets 66, 68 through which fuel may be added to the main fuel chamber 32. A return fuel inlet 66 communicates with a fuel return line (not shown) through which excess fuel delivered to and not used by the engine is returned to the fuel vapor separator 10. Fuel is received into the main fuel chamber 32 from a fuel tank through a fuel inlet 68. The main body 12 preferably also has a second coolant inlet 74 that communicates a coolant source with a heat exchanger 72 preferably disposed within the main fuel chamber 32 and through which coolant flows.

In one presently preferred embodiment, the heat exchanger is a tubular coil 72 formed of a material preferably having high thermal conductivity such as a metal, and preferably corrosion resistant, such as stainless steel. The coil 72 leads to a second coolant outlet 70 formed in the main body 12 and into which one end of the coil 72 extends to permit coolant to be discharged from the coil 72. To prevent coolant from contaminating the fuel supply in the main fuel chamber 32, and to prevent fuel in the main fuel chamber 32 from leaking out of the fuel vapor separator 10, the coil 72 is preferably sealed in the second coolant inlet and outlet 70, 74. Relatively cool fluid is passed through the coil 72, such as water, particularly when the fuel vapor separator 10 is used with a marine engine. Heat from relatively hot fuel in the main fuel chamber 32 is transferred to the coolant in the coil 72 to cool the bulk fuel in the main fuel chamber 32.

As shown in FIG. 2, in addition to being supported by the main body 12 at both the inlet 74 and outlet 70 into which the coil 72 extends, a support 76 may be provided adjacent to a lower end of the coil 72. The support 76 may include one or more flexible fingers 78 that are loaded against and preferably support the coil 72 at one or more spaced locations. The load on the coil 72 provided by the fingers 78 helps to minimize damage to and prevent potential dislodging of the coil 72 from the inlet 74 and outlet 70 that may occur as a result of vibration. Desirably, one of the fingers 78 preferably includes a catch 80 that prevents movement of the coil 72 in a direction tending to remove the ends of the coil 72 from the inlet 74 and outlet 70 of the main body 12. The finger 78 with the catch 80 may be deflected by the coil 72 as the ends of the coil 72 are pressed into the coolant inlet 74 and outlet 70. When the ends of the coil 72 are fully received in the coolant inlet 74 and outlet 70, the coil 72 passes over the catch 80 so that its finger 78, when no longer deflected, returns to its initial position wherein the catch 80 is aligned with and behind the coil 72 to prevent lateral movement of the coil 72.

Figure 17:
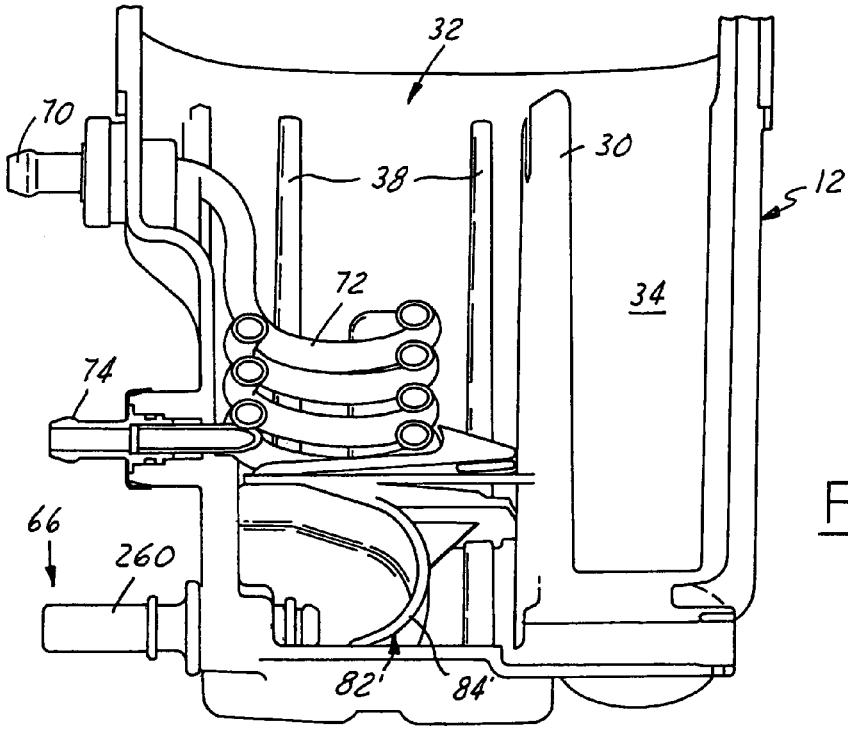
FIG. 17 is a fragmentary perspective sectional view illustrating a third embodiment of a baffle arrangement for a fuel vapor separation.

As best shown in FIG. 2, a baffle assembly 82 may be provided in the main fuel chamber 32 generally adjacent to the return fuel inlet 66 and fuel inlet 68. The baffle assembly 82, in one presently preferred embodiment, includes a curved or arcuate wall 84 arranged so that fuel received through the return fuel inlet 66 and fuel inlet 68 is directed around an inner surface 86 of the curved wall 84 so that centrifugal force separates liquid fuel from the fuel vapor. The liquid fuel can then be directed through openings in the curved baffle wall 84 toward the cooling coil 72 or a wall of the vapor separator that is preferably spaced from the inlet 16 of the high pressure fuel pump 14 to prevent this dynamic fuel flow from being directly communicated with the inlet 16 of the high pressure fuel pump 14. The fuel vapor can be directed upwardly in the main fuel chamber 32 so that it can be separated from the liquid fuel and vented from the fuel vapor separator 10. The baffle 82 can be made of any suitable fuel and corrosion resistant material including polymeric materials such as polyamides (one example is Nylon), polyphthalimides (one example is Amodel), Acetal, and the like, each of which can be glass and/or mineral filled if desired, or corrosion resistant metal such as stainless steel. Desirably, an upper wall 88 of the baffle 82 may support the fingers 78 of the support 76 for the coil 72. The baffle 82 may be of any suitable design. As shown in FIG. 17, an alternate baffle 82' has a curved wall 84' that is oriented horizontally or offset from the first embodiment baffle 82.

Figure 5:
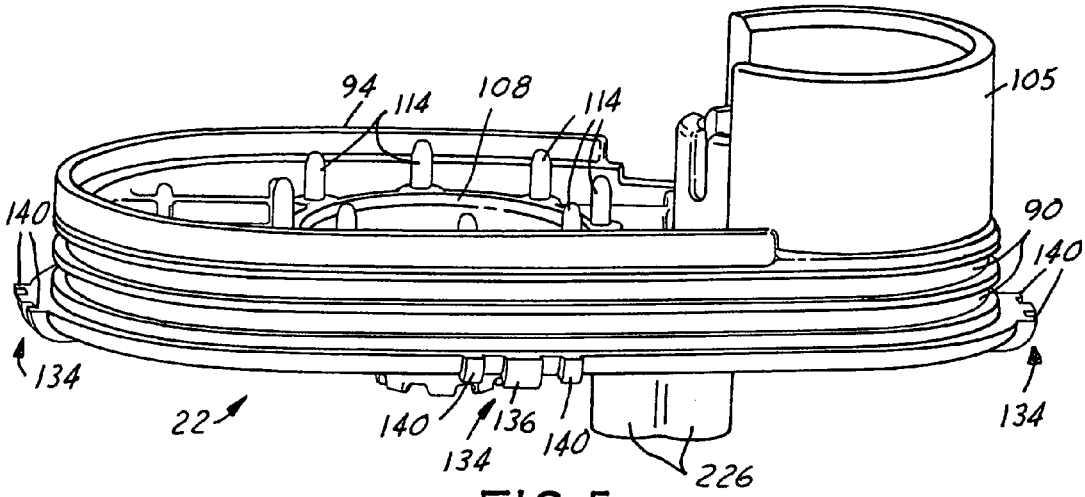
FIG. 5 is a perspective view of a lid of the fuel vapor separator of FIG. 1.
Figure 6:
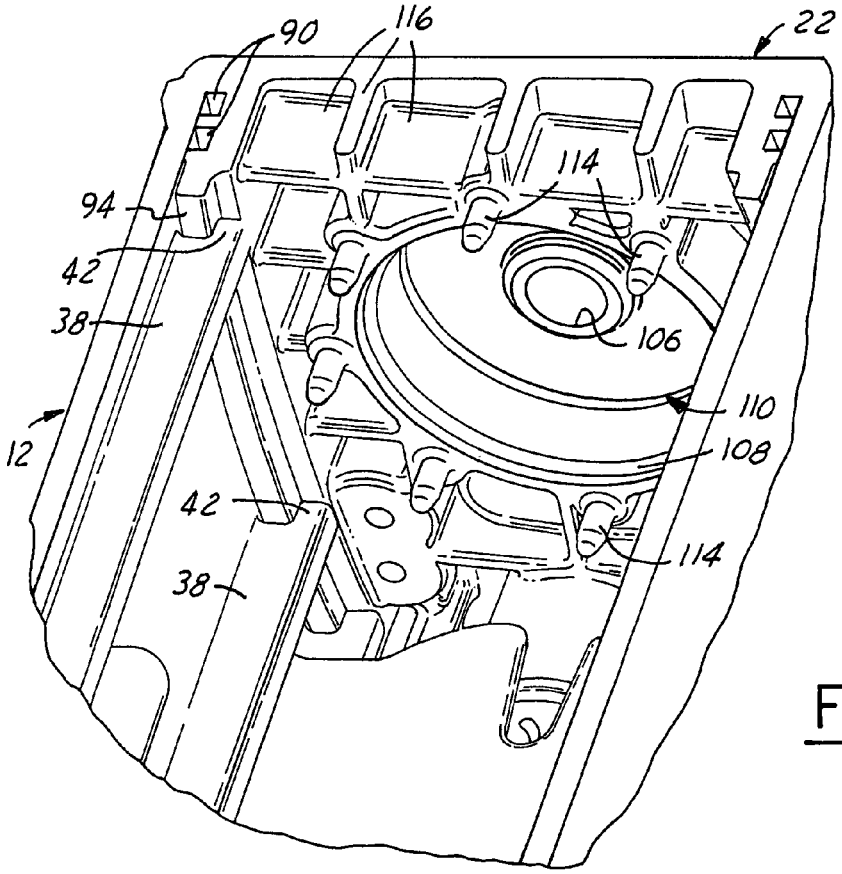
FIG. 6 is a fragmentary perspective sectional view of a portion of the fuel vapor separator illustrating an interconnection between the lid and main body.
Figure 7:
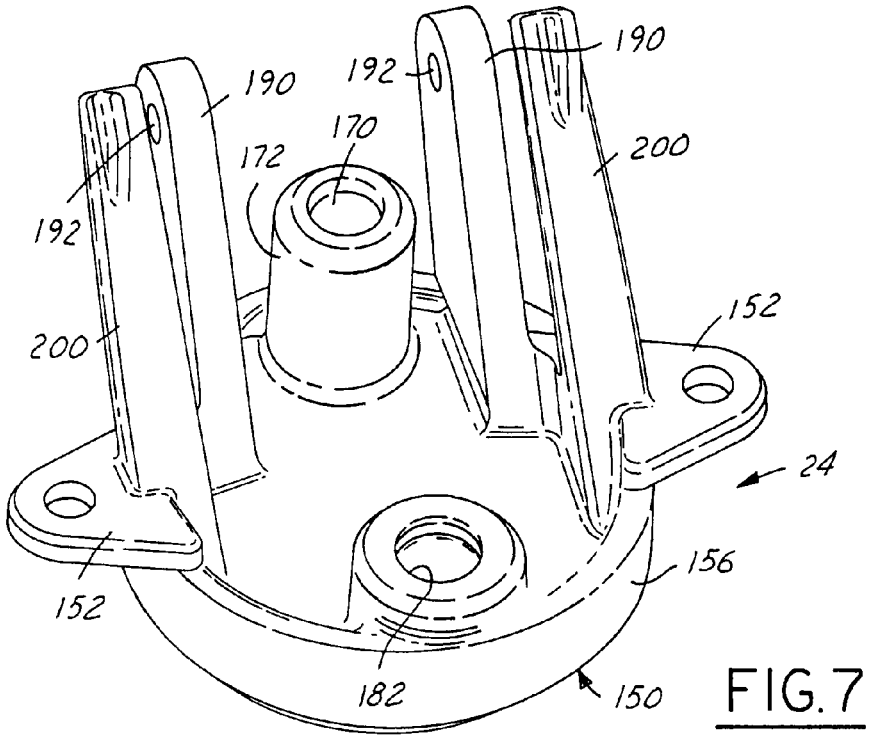
FIG. 7 is a perspective view of a vent valve body of a fuel vapor separator.
Figure 8:
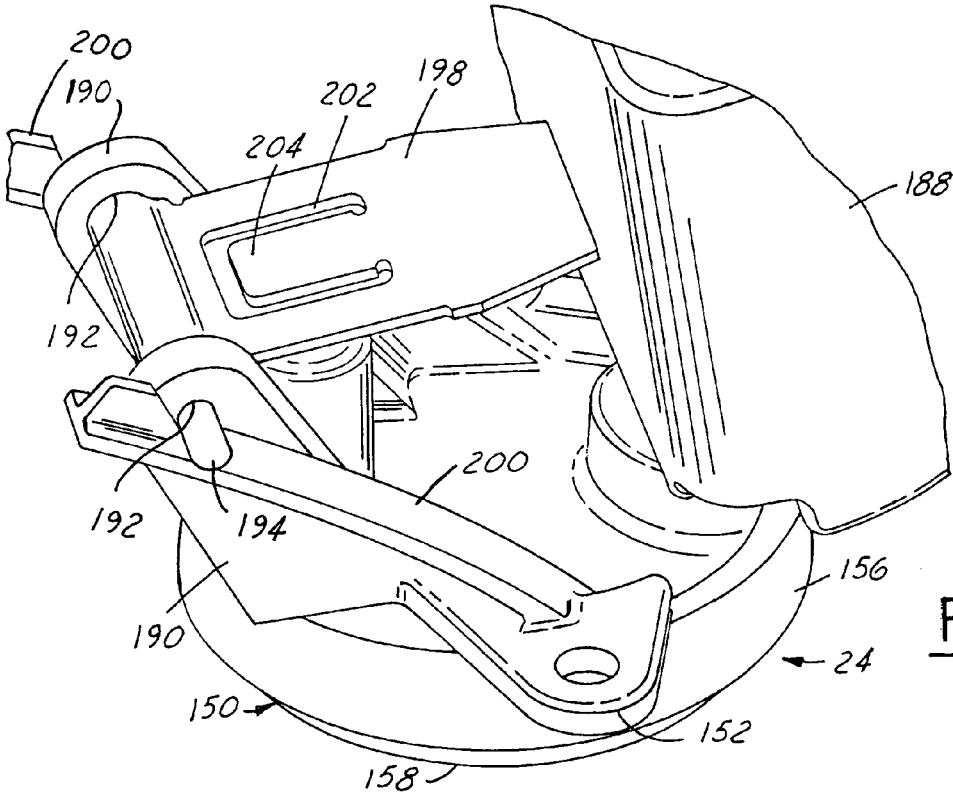
FIG. 8 is a fragmentary perspective view of the fuel vent body including a float and float arm assembly.
Figure 11:
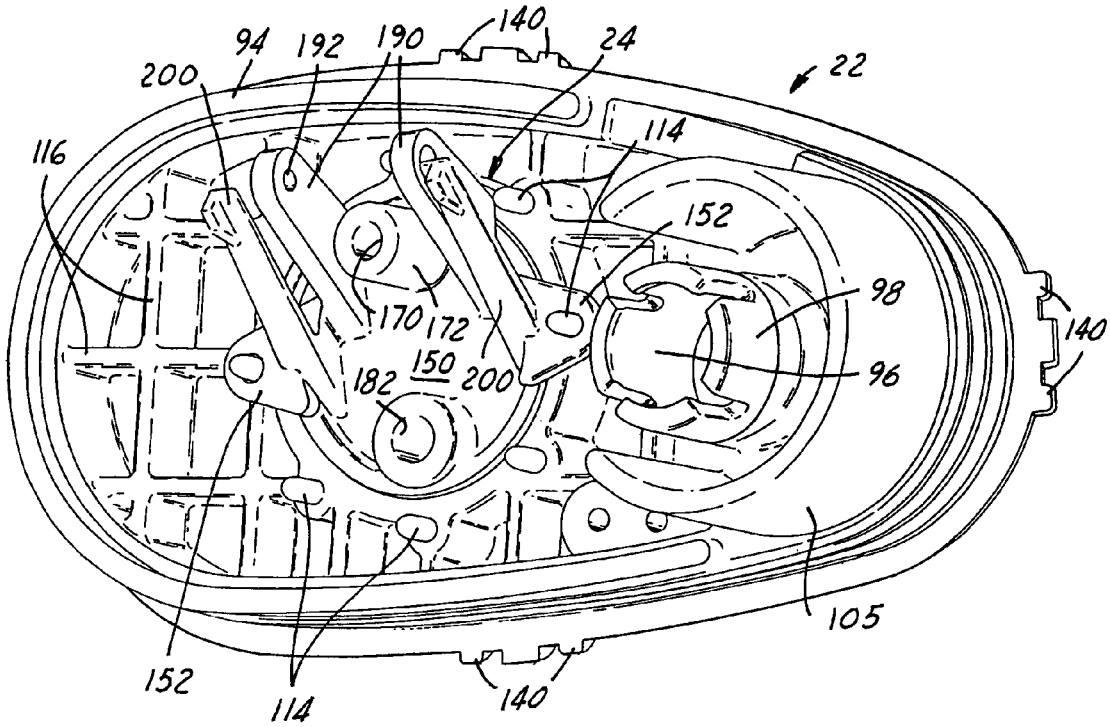
FIG. 11 is a perspective bottom view of the lid including the vent valve body with the float and float arm removed.

As best shown in FIGS. 5, 6 and 11, the lid 22 of the fuel vapor separator 10 is preferably shaped generally complementary to the open upper end 20 of the main body 12. The lid 22 preferably includes at least one and preferably more than one peripheral groove 90 each adapted to receive a seal 92, such as an O-ring or gasket to prevent fuel vapor or liquid fuel from leaking between the main body 12 and lid 22. The lid 22 also preferably includes a depending rim 94 disposed generally about the periphery of the lid 22 and adapted to be received, as shown in FIGS. 1 and 6, in the recess 44 of each rib 38 and between the inner surface 40 of the main body 12 and the upstanding fingers 42 on the ribs 38. Desirably, the rim 94 has a width providing a close fit between the inner surface 40 of the main body 12 and the upstanding fingers 42 to securely hold the lid 22 in place and prevent lateral deflection of the main body 12 and lid 22. Desirably, this maintains the seals 92 in close engagement with the main body 12 to prevent leakage between the lid 22 and main body.

The lid 22 includes a first opening 96 therethrough, and preferably has a depending annular skirt 98 surrounding the opening 96 to receive a fitting 99 that defines a fuel passage 100 in communication with the opening 96. The fitting 99 extends out of a recess 101 in the lid 22. The depending skirt 98 preferably receives an outlet tube 102 extending from the outlet 18 of the high pressure fuel pump 14 and through which pressurized fuel is discharged from the fuel pump 14. Desirably, to prevent leakage of the discharged output fuel, a seal 104 such as an O-ring is disposed between the annular skirt 98 and the outlet tube 102. A second depending skirt 105 may be formed as a partial cylinder surrounding a portion of the skirt 98.

The lid 22 preferably includes a vent opening 106 therethrough that is preferably surrounded by an annular depending skirt 108 defining a cavity 110 in which a vapor vent valve 24 may be mounted to facilitate venting fuel vapors from the liquid and vapor separator 10. A plurality of depending posts 114 may be formed integrally with or carried by the skirt 108 about the periphery of the cavity 110. For increased rigidity and strength, a plurality of ribs 116 may be formed in the lid 22 as best shown in FIGS. 6 and 11. The vent opening 106 may include a through bore, a first counterbore 118 and a second counterbore 120, with the counterbores 118, 120 defining radially inwardly extending shoulders 122, 124, respectively.

Figure 9:
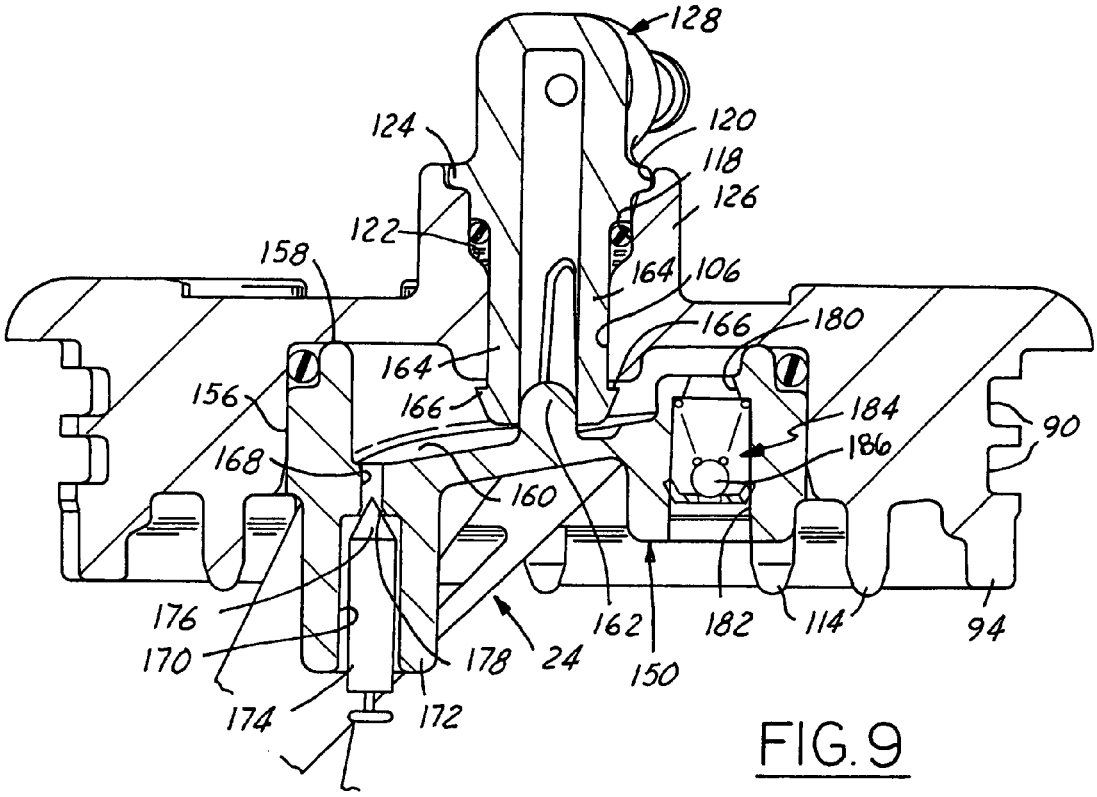
FIG. 9 is a cross-sectional view illustrating the vent valve body carried by the lid of the fuel vapor separator.
Figure 14:
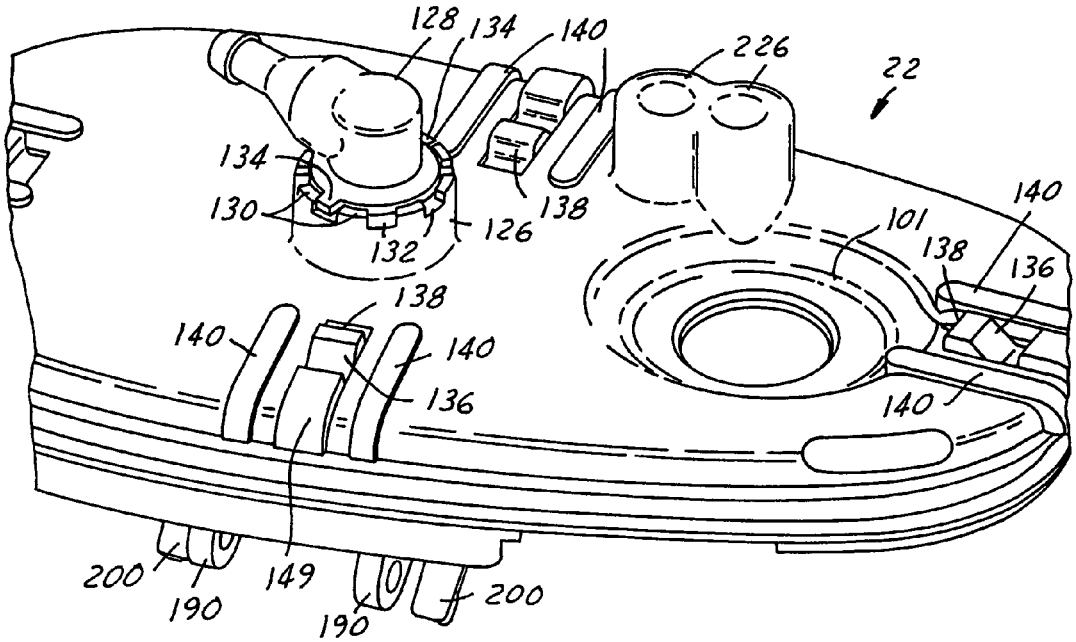
FIG. 14 is a fragmentary perspective view of the lid of the fuel vapor separator illustrating the connection of a vapor vent fitting on the lid.
Figure 15:
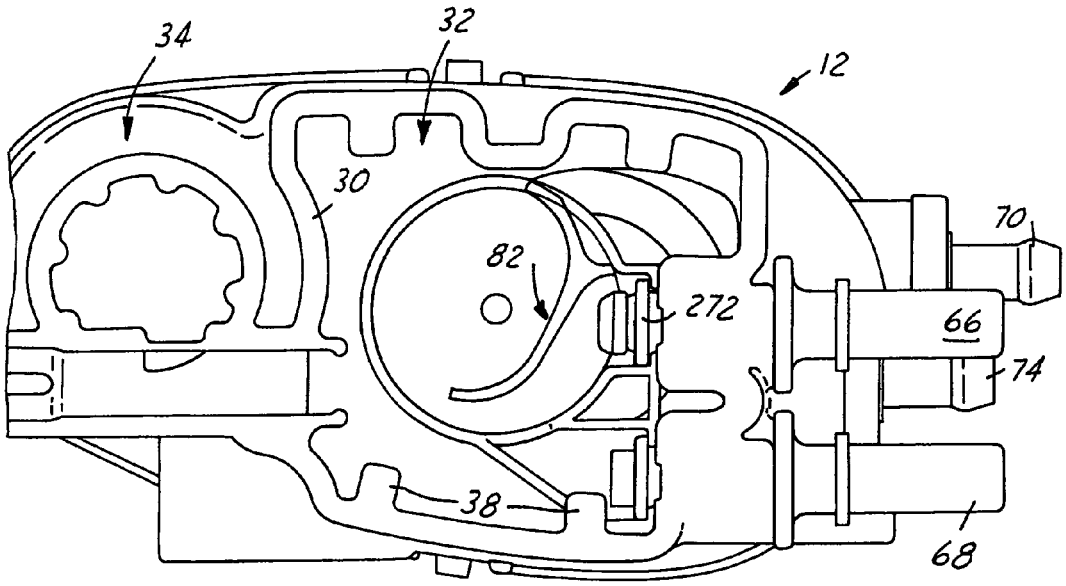
FIG. 15 is a cross-sectional view of the main body of the vapor separator illustrating a baffle arrangement.

On the exterior of the lid 22, an upstanding annular wall 126 is preferably provided surrounding the vent opening 106. As best shown in FIGS. 9 and 14, the upstanding wall 126 preferably receives a vent outlet fitting 128 that communicates with the vapor vent valve 24 and receives a vent line or conduit through which fuel vapor is vented out of the fuel vapor separator 10. The upstanding wall 126 may have a plurality of castle-like projections 130 spaced apart by intervening recesses 132. The outlet vent fitting 128 preferably has one or more radially outwardly extending tabs 134 that are received in the recesses 132 between adjacent castle-like projections 130 to hold the vent fitting 128 against rotation when it is mounted on the lid 22. Desirably, a plurality of castle-like projections 130 and intervening recesses 132 are provided enabling the vent fitting 128 to be mounted in a number of different angular or rotational orientations.

As best shown in FIGS. 7–11, the vapor vent valve 24 is preferably adapted to be received in the cavity 110 formed in the lid 22. The vapor vent valve 24 preferably includes a main body 150 with a pair of generally radially outwardly extending flanges 152 including through holes that may be received on the posts 114 surrounding the cavity 110 and extending from the lid 22 in the direction of the main fuel chamber 32. Preferably, a plurality of circumferentially spaced posts 114 are provided permitting the circumferential or angular orientation of the body 150 to be varied relative to the lid 22 as desired for a particular embodiment. Radial orientation of the body 150 enables desired orientation of the valve 24 relative to the axis of the engine that the vapor separator 10 is used with to enable increased tilt and trim angles (in a marine application) with the vapor separator 10 in all directions without permitting fuel leakage from the vent opening 106. After the valve 24 is mounted with the posts 114 extending through the holes in the mounting flanges 152, the posts 114 may be heat staked or otherwise deformed to attach the body 150 to the lid 22, or a clip or retainer may be fitted onto the posts 114, or the body 150 may be welded or bonded such as by an adhesive, or otherwise physically or mechanically attached to the lid 22.

Figure 10:
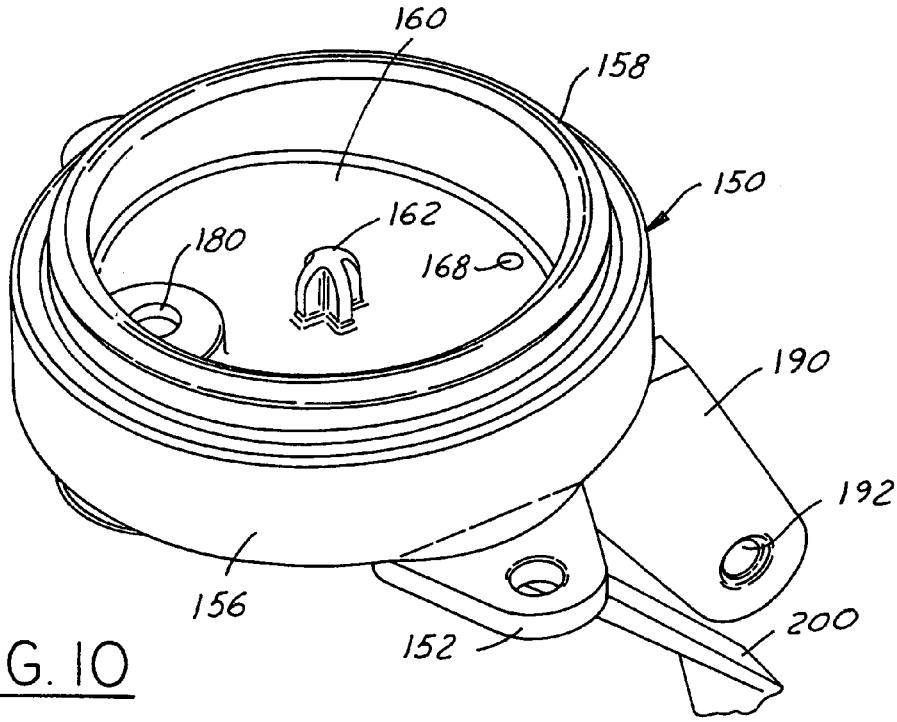
FIG. 10 is a perspective top view of the vent valve body.

The main body 150 of the vent valve 24 is preferably molded from a plastic material to eliminate the need to machine the body 150, eliminate corrosion, and provide a low weight and relatively low cost main body. The main body 150 preferably includes a circumferentially continuous and generally cylindrical side wall 156 including an upstanding and generally cylindrical rim 158, and a main wall 160 at least substantially spanning the area bounded by the side wall 156. The side wall 156 is sized to be received within the cavity 110 of the lid 22, as best shown in FIG. 9, and the rim 158 is adapted to engage the lid 22 to limit insertion of and locate the valve housing 24 relative to the lid 22. The main wall 160, as best shown in FIGS. 9 and 10, preferably includes an upstanding post 162 that in assembly is received in an end of the vent fitting 128 and may capture and locate that end of the vent fitting 128.

The vent fitting 128 preferably includes a plurality of depending legs 164 that are flexible and resilient and have laterally or radially outwardly extending catches 166 thereon. The legs 164 are flexed inwardly when the vent fitting 128 is pressed into the vent opening 106 and flex outwardly when the catches 166 of the legs 164 pass the lid wall so that the catches 166 radially overlie the lid 22 to secure the vent fitting 128 therein. The post 162 is disposed between the legs 164 in the inner diameter of the vent fitting 128 to substantially prevent radially inward movement of the legs 164 and thereby prevent removal of the vent fitting 128 from the lid 22. Although molded as part of the main body 154 in the presently preferred embodiment, the post 162 could be a separate component as desired. The post 162 preferably has at least one recess and may be generally X-shaped in cross-section providing gaps or passages through which fuel vapor may flow between the post 162 and the vent fitting 128. The vent fitting 128 may be communicated with an engine intake chamber so the fuel vapor may be fed to the engine for combustion.

A first vent bore 168 is formed through the main wall 160 and is preferably aligned with and open to a counterbore 170 formed in a cylindrical projection 172 extending from the main wall 160. The cylindrical projection 172 is adapted to slidably receive a vent valve body 174 therein to selectively open and close the main vent bore 168 as a function of the level of liquid fuel in the main fuel chamber 32. In that regard, the vent valve body 174 includes a valve head 176 adapted to engage a valve seat 178 to close the vent bore 168 when desired. The main wall 160 preferably also includes a second bore 180 therethrough that is generally aligned with and open to a counter bore 182 formed in a second cylindrical projection extending from the main wall 160. The counter bore 182 is adapted to receive a pressure relief valve 184 including a valve head 186 that prevents fluid from flowing through the second valve bore 180 until a predetermined threshold pressure is reached or exceeded in the main fuel chamber 32. In other words, the pressure relief valve 184 limits the maximum pressure in the main fuel chamber 32 to prevent damage to the fuel vapor separator 10 and associated components.

To connect the vent valve 24 to a float 188 (FIG. 8), the main body 150 preferably includes a pair of spaced apart flanges 190 extending into the main fuel chamber 32 and preferably including aligned holes 192 or slots therein. A pivot pin 194 is received through the holes 192 and through a bore (not shown) in a float arm 198 to pivotally connect the float arm 198 to the flanges 190. Laterally spaced from the flanges 190 that mount the pivot pin 194, are a pair of flexible and resilient legs 200 which can be pulled back past the holes 192 through which the pivot pin 194 is mounted and then released against the pivot pin 194 after it is installed so that the legs 200 are loaded against the pivot pin 194 to retain it in the openings 192. Desirably, because the legs 200 are flexible, they also minimize motion of the pin 194 such as may be caused by mechanical shock or vibration that could result in wear of the pin 194. Since the pivot pin 194 is retained by the flexible legs 200, slots rather than the holes 192 could be used to make assembly of the pivot pin 194 and float 188 onto the vent valve 24 even easier. At its other end, the float arm 198 is preferably coupled to the float 188 that is responsive to the level of liquid fuel in the fuel chamber, as will be set forth in more detail below. The float arm 198 preferably includes a generally U-shaped slot 202 defining a finger 204 that may be disposed around a generally complementary attachment feature formed on the vent valve body 174 to connect the vent valve body 174 to the float arm 198.

Accordingly, as the level of liquid fuel in the main fuel chamber 32 changes, the float 188 pivots the float arm 198 about the pivot pin 194 and thereby moves the vent valve body 174 within the first cylindrical projection 172 and relative to the valve seat 178. When the level of liquid fuel reaches a predetermined maximum level, the vent valve head 176 is engaged with the valve seat 178 to close the first vent valve 174 and thereby prevent fuel vapor and/or liquid fuel from escaping through the first vent bore 168. When a lower level of liquid fuel is present, the float 188 maintains the valve head 176 spaced from the valve seat 178 to permit fuel vapor in the main fuel chamber 32 to vent out of the fuel chamber 32 through the vent bore 168 and the vent fitting 128.

The main wall 160 of the valve body 150, as best shown in FIGS. 9 and 10, is preferably inclined toward the main vent bore 168 so that any liquid fuel that passes through the main vent bore 168 or pressure relief valve bore 180 can drain back into the main fuel chamber 32 when the vent valve 24 is open. Desirably, this prevents or inhibits the discharge of liquid fuel through the vent fitting 128. Also preferably, the main vent bore 168 and the pressure relief valve bore 180 are spaced radially away from the opening of the vent fitting 128 so that any liquid fuel which passes through the valve bores 168, 180 must flow through an at least somewhat circuitous path prior to reaching the opening of and flowing through the vent fitting 128. Accordingly, liquid fuel is further inhibited from flowing out of the vent fitting 128.

Figure 12:
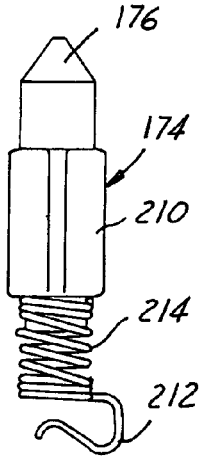
FIG. 12 is a side view of a vent valve according to one embodiment of the fuel vapor separator.
Figure 13:
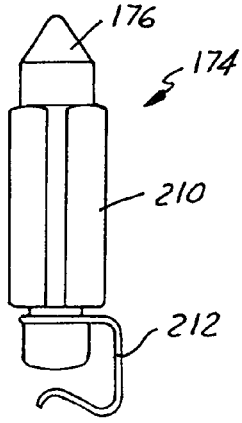
FIG. 13 is a side view of an alternate embodiment of a vent valve.

As shown in FIGS. 12 and 13, the vent valve body 174 may include a shank 210 that permits fluid flow between it and the valve body 150 in which it is received, and a conical or frusto conical valve head 176 adapted to engage the valve seat 178 to close the vent bore 168. Opposite to the valve head 176, a wire clip 212 may be provided to connect the valve body 174 to the finger 204 of the float arm 198. A spring 214 may be disposed between the clip 212 and the valve body 174, as shown in FIG. 12 to provide a more flexible and a yieldably biased coupling between the main valve body 174 and the float arm 198. The spring 214 may be desirable to absorb vibration that could cause the float valve 174 to bounce and intermittently unseat the valve potentially allowing liquid fuel to pass therethrough. The valve body 174 is shown in FIG. 13 without the spring 214. The float 188 is preferably a molded closed-cell foam. It could be any desired shape and size. The float can be of substantially any other suitable construction, including by way of example without limitation, blow molded plastic, hollow injection molded plastic, and foamed nylon. It is preferable to maximize the length of the float arm 198 from the center of gravity of the float 188 to the valve body 174 to provide increased responsiveness of the valve body 174 and prevent corking of the valve 174, and also to provide a float 188 that is as heavy as possible while also providing the desired buoyancy. The longer float arm 198 also provides more force to close the vent valve 174 to better prevent liquid fuel from flowing out of the main vent bore 168.

Also on the exterior of the lid 22, in one presently preferred embodiment, a plurality of latch surfaces 134 are preferably provided with each latch surface 134 having at least one ramp 136 and at least one retaining shoulder or catch surface 138. Each latch 134 is preferably circumferentially aligned with a corresponding latch surface 46 on the main body 12. Each latch 134 is adapted to receive a retaining clip 51 that secures the lid 22 to the main body 12 as will be set forth in more detail below. To prevent lateral movement of the retaining clip 51 relative to the latch 134, a plurality of upstanding rails or ribs 140 are preferably provided on the lid 22 with one rib 140 on each side of each latch 134.

Figure 19:
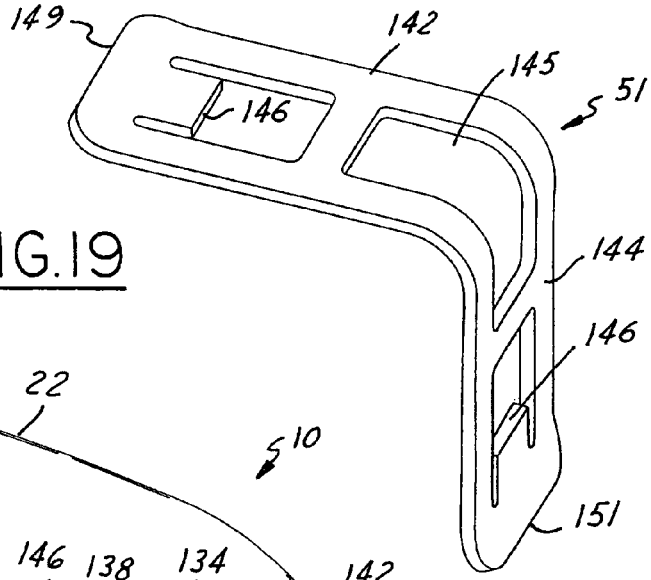
FIG. 19 is a perspective view of a retaining clip used to secure the lid to the main body.
Figure 20:
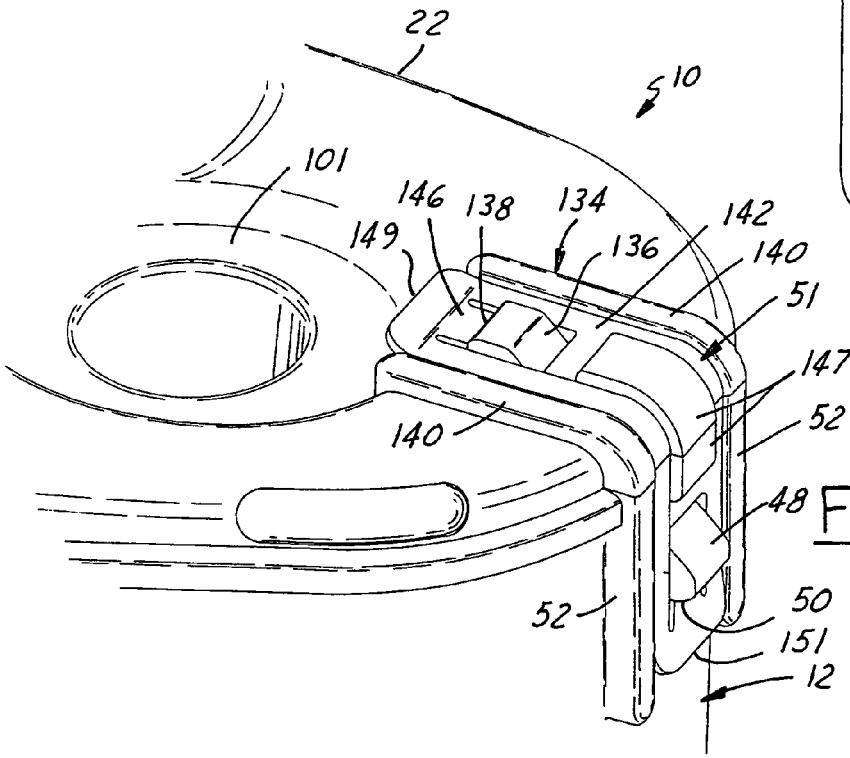
FIG. 20 is a fragmentary perspective view illustrating the lid secured to the main body by a retaining clip.

One presently preferred embodiment of a retaining clip 51 is shown in FIG. 19. The retaining clip 51 is preferably resilient and flexible, and is preferably formed of metal for increased strength. The retaining clip 51 is preferably L-shaped having a first surface 142 adapted to overly a portion of the lid 22, a second surface 144 adapted to overly a portion of the side wall 26 of the main body 12, and a pair of inwardly facing tabs 146 each adapted to engage a separate one of the latches 46, 134 on the lid 22 and main body 12. A window 145 may extend into each surface, and may be received over aligned protrusions 147 on the lid 22 and main body 12. To facilitate handling and assembly, the opposed ends 149, 151 of the clip 51 may be bent. The clips 51 may be symmetrical so that they can be used in both orientations wherein the clips 51 align with the latches 46, 134.

To secure the lid 22 to the main body 12, a plurality of retaining clips 51 are preferably used. The retaining clips 51 are preferably evenly spaced about the perimeter of the lid 22 and main body 12 to provide a generally uniform force clamping the lid 22 to the main body 12. To install a retaining clip 51, it is aligned generally with the lid 22 and main body 12 so that the tabs 146 of the retaining clip 51 are aligned with the ramps 48, 136 of the aligned latches 46, 134. The retaining clip 51 is then pushed onto the lid 22 and main body 12 which flexes the resilient retaining clip 51 as the tabs 146 pass over the respective ramps 48, 136. When the tabs 146 are moved beyond the ramps 48, 136 the resilient clip 51 returns at least partially to its unflexed position so that each tab 146 overlies a respective catch surface 50, 138, one on the lid 22 and the other on the main body 12.

With the catch surfaces 50, 138 of the latches 46, 134 facing in generally opposed directions, an upward force on the lid 22, such as caused by internal pressure in the fuel vapor separator 10 that tends to move the lid 22 off the main body 12, is resisted by engagement of the tabs 146 of the retainer clip 51 with the catch surfaces 50, 138. Desirably, the distance between the catch surfaces 50, 138 is slightly greater than the distance between the inner surface of the tabs 146 on the retaining clip 51 when the retaining clip 51 is at rest so that the retaining clip 51 is under tension and somewhat flexed in assembly to provide an increased force holding the lid 22 on the main body 12. To facilitate service of the fuel vapor separator 10, the retaining clips 51 may be removed by lifting or prying one end of the retaining clip 51 until the adjacent tab 146 passes its corresponding catch surface 50 or 138. The retaining clips 51 may be reusable, or they may become deformed upon removal from the fuel vapor separator 10. The retaining clips 51 may be formed from stamped stainless spring steel and bent into their final shape. After installation of the clips 51, the latches 46, 134 on the lid 22 and main body 12 can be deformed to inhibit removal of the lid 22 from the main body 12. In this regard, the assembly can be made more tamper resistant.

Figure 29:
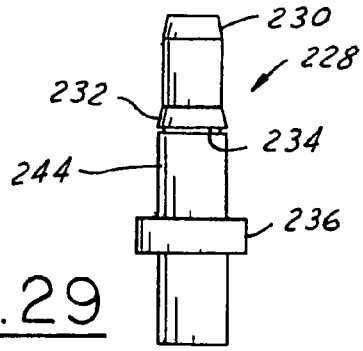
FIG. 29 is a side view of a pin utilized in the electrical pass through arrangement of FIG. 28.
Figure 28:
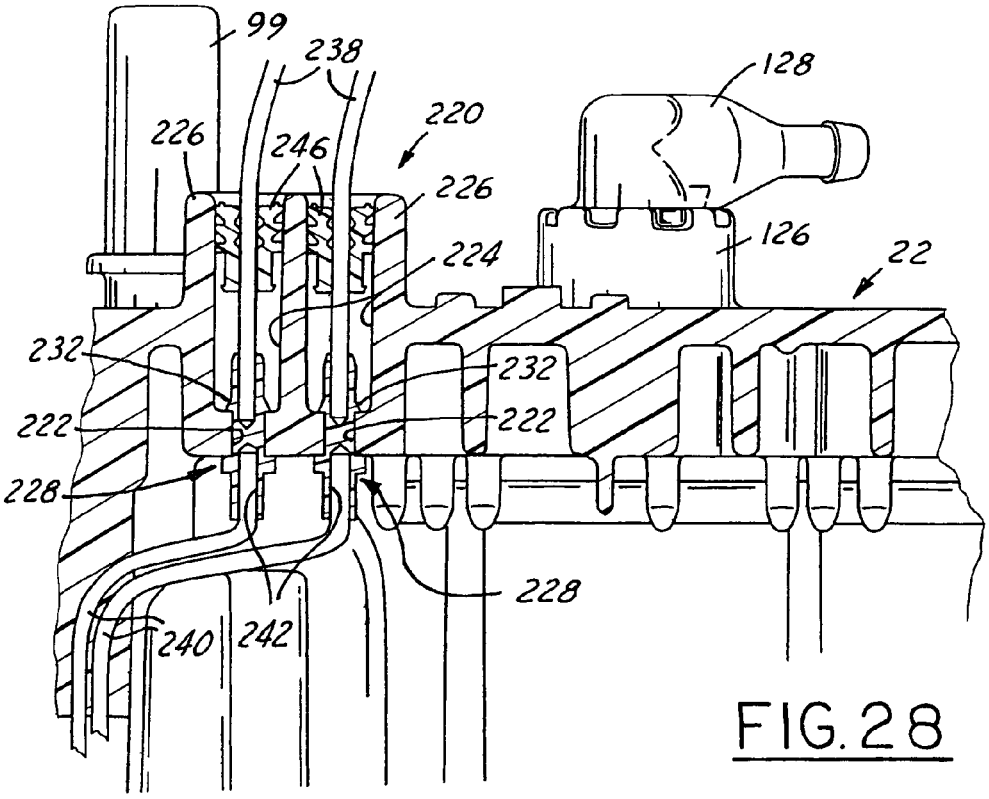
FIG. 28 is a fragmentary sectional view illustrating an electrical pass through section of a lid of a fuel vapor separator.

As best shown in FIGS. 28 and 29, to provide electrical power to the high pressure fuel pump 14, an electrical pass through connector section 220 is provided in the lid 22. The connector section 220 preferably includes at least two laterally spaced bores 222 that pass through the lid 22, each communicating with a counter bore 224 formed in cylindrical projections 226 that may extend outwardly from the lid 22. An electrically conductive pin 228 is preferably press fit into each bore 222 with opposed ends of the pins 228 extending out of the opposed sides of the bore 222.

To facilitate press fitting each pin 228 into the bore 222 and retaining it therein, the pin 228 preferably includes a reduced diameter insertion end 230 which may include a tapered or generally frustoconical portion to facilitate initially aligning the pin 228 with the bore 222. Spaced inboard from the insertion end 230 is a preferably radially outwardly extending barb 232 that is preferably tapered to facilitate pressing the barb 232 through the bore 222, and has a generally planar shoulder 234 that overlies a shoulder defined by the counter bore 224 after the barb 232 is press fit through the bore 222 to inhibit or prevent removal of the pin 228 from the bore 222. To prevent the pin 228 from being pulled through the bore 222, a radially outwardly extending flange 236 is provided axially spaced from the barb 232.

Between the barb 232 and the flange 236, the pins 228 preferably have a generally cylindrical portion 244 having an outer diameter adapted to be closely received, preferably with a significant friction fit, in the bores 222. The generally cylindrical portion 244 may be provided with a reverse taper wherein its circumference is greater adjacent to the barb 232 than it is adjacent to the flange 236 to provide improved sealing and also improve resistance to the pin 228 backing out of the lid 22. This reduces or prevents fluid leakage between the pins 228 and the lid 22. If desired, for additional resistance to hydrocarbon permeation from the fuel vapor separator, seals can be added to the pins 228. The seals may be O-rings, such as fluorocarbon O-rings. In one presently preferred embodiment, grommets 246 are provided around the wires 238 extending out of the liquid vapor separator 10 to prevent contaminants from entering the counterbore 224. The pins 228 may be made of tin plated brass but could be any suitable, conductive material. The pins 228 can be any size desired to accommodate a desired gauge of wire or mating terminal.

To provide electrical power to the pin 228, an electrical wire 238 is connected at one end to one end of the pin 228 and is communicated with a power source. A second electrical wire 240 is connected at one end to the pin 228 and its other end to the high pressure fuel pump 14 to provide power to the fuel pump 14. To facilitate connecting the wires 238, 240 to the pins 228, the ends of the pin 228 may be provided with blind bores 242, but to prevent fluid leakage through the pins 228, the pins 228 preferably include a solid portion between the bores 242. The wires 238, 240 can be attached to the pins 228 using conventional techniques such as crimping, solder, etc. The pins 228 can be solid and shaped to receive a terminal such as a socket type terminal that is press fit over the end of the pin 228 and may be connected such as by crimping or solder thereto.

Figure 18:
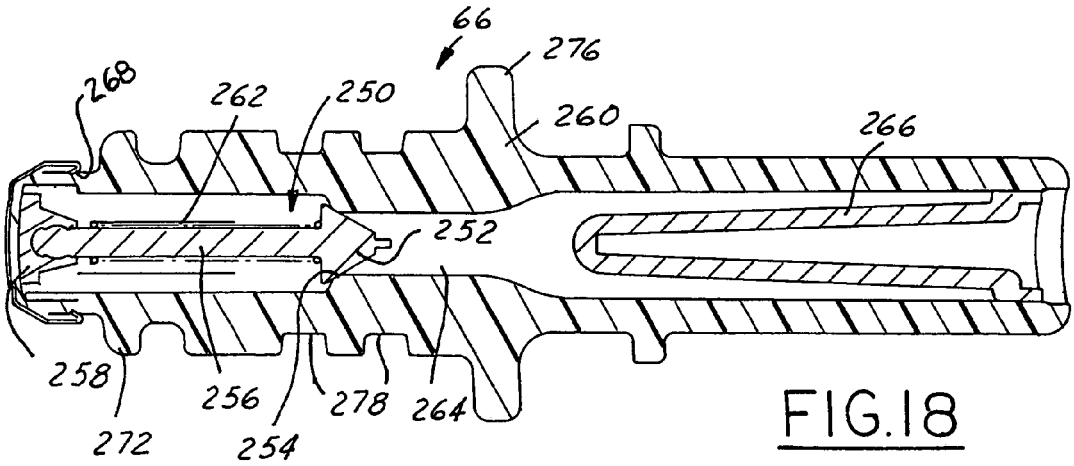
FIG. 18 is a cross-sectional view of a fuel inlet fitting including a check valve.

With the lid 22 fixed on and sealed to the main body 12, fuel pressure upstream of the fuel vapor separator 10 (e.g. in a fuel rail) is controlled by a check valve 250 in the return fuel path. Preferably, as shown in FIG. 18, the check valve 250 is disposed in the return fuel inlet 66 through which return fuel is provided into the main fuel chamber 32. The check valve 250 includes a valve head 252 having an outer diameter adapted to engage and become sealed against a valve seat 254 provided in the return fuel inlet 66. The valve head 252 is connected to a valve shank 256 that is slidably received relative to a valve guide retainer 258 carried by a return fuel inlet fitting 260. A spring 262 is preferably disposed between the retainer 258 and the valve head 252 to yieldably bias the valve 250 to its closed position wherein the valve head 252 is sealed against the valve seat 254 preventing fuel flow through a passage 264 of the inlet fitting 260. A filter 266 or screen may also be integrated into the inlet fitting 260 to remove at least some debris or other contaminants that may otherwise cause the valve 250 to malfunction, such as by sticking in its open position. Fuel pressure upstream of the fuel vapor separator 10 (e.g. in a fuel rail) is determined at least in part by the size of the hole bounded by the valve seat 254, and the force of the spring 262 acting on the valve 250. The retainer 258 may have an inwardly bent flange 268 adapted to be received in a circumferential groove 270 in the exterior of the inlet fitting 260.

Figure 16:
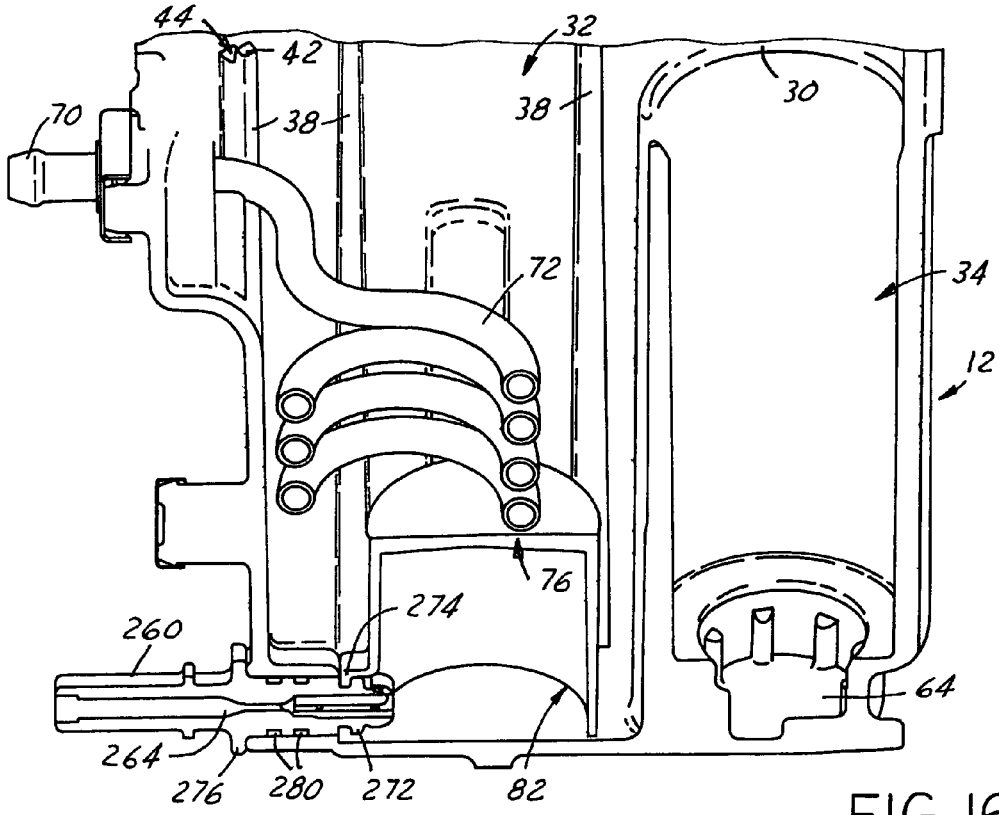
FIG. 16 is a fragmentary perspective sectional view illustrating a second embodiment of a baffle arrangement for the fuel vapor separator.

The return fuel inlet fitting 260 preferably also has a radially outwardly extending flange 272 that may be engaged by the retainer adapted to retain the inlet fitting 260 in the main body 12 of the fuel vapor separator 10. In one presently preferred embodiment, as shown in FIG. 16, a lip 274 of the baffle 82 is disposed in between the flange 272 and a portion of the main body 12 to prevent the inlet fitting 260 from being pulled out of the main body 12 of the fuel vapor separator 10. A second radially outwardly extending flange 276 on the inlet fitting 260 limits insertion of the inlet fitting 260 into the main body 12. One or more external grooves 278 (FIG. 18) in the inlet fitting preferably receive seals 280 (FIG. 16), such as O-rings, to provide a fluid-tight seal between the inlet fitting 260 and the main body 12. The fuel inlet 68 may also include a similar separate fitting retained in the main body 12 of the fuel vapor separator 10 by a retainer, such as a depending flange of the baffle, or some other component in the fuel vapor separator 10. The return inlet fitting 260 and fuel inlet fitting could be formed integrally with the main body 12, with the return inlet check valve 250 assembled into the return inlet fitting 260 during assembly of the fuel vapor separator 10.

Figure 21:
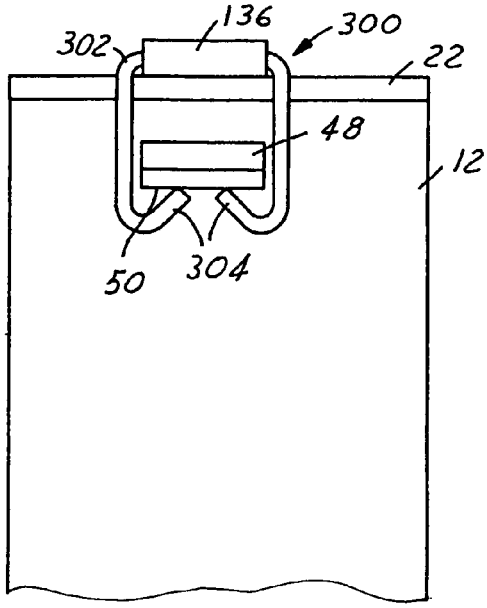
FIG. 21 is a diagrammatic view illustrating an alternate retaining clip arrangement for securing the lid to the main body.
Figure 22:
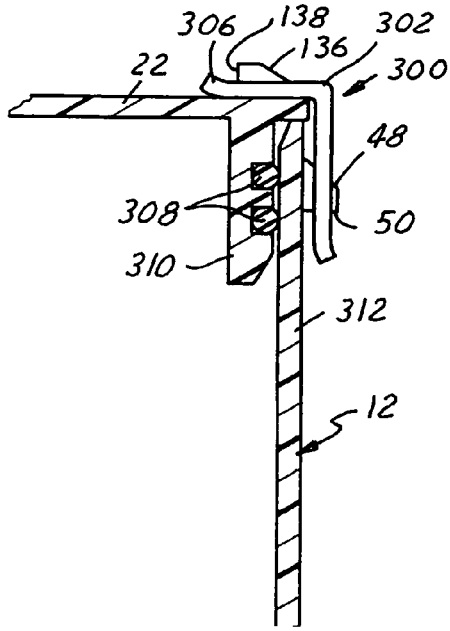
FIG. 22 is a fragmentary sectional view illustrating the retaining clip assembly of FIG. 21.

Instead of or in addition to the retaining clips 51, alternate mechanisms can be used to retain the lid 22 on the main body 12 of the fuel vapor separator 10. FIGS. 21 and 22 illustrate an alternate embodiment of a retaining clip 300 that includes a generally U-shaped and somewhat flexible and resilient wire 302 with inwardly bent ends 304. The wire 302 is looped so that a base 306 of the 'U' abuts the catch surface 138 of the latch 134 on the lid 22, with the wire 302 passing on either side of the catch surface 50 on the main body 12 with the ends 304 disposed beneath and engaged with the catch surface 50 of the latch 46 on the main body 12. Of course, the orientation of the wire 302 could be reversed with respect to the latches 46, 134 on the lid 22 and main body 12. In this embodiment, a pair of circumferentially continuous seals 308 can be provided between a depending skirt flange 310 of the lid 22 and a sidewall 312 of the main body 12 to provide a fluid-tight seal between the lid 22 and main body 12.

Figure 23:
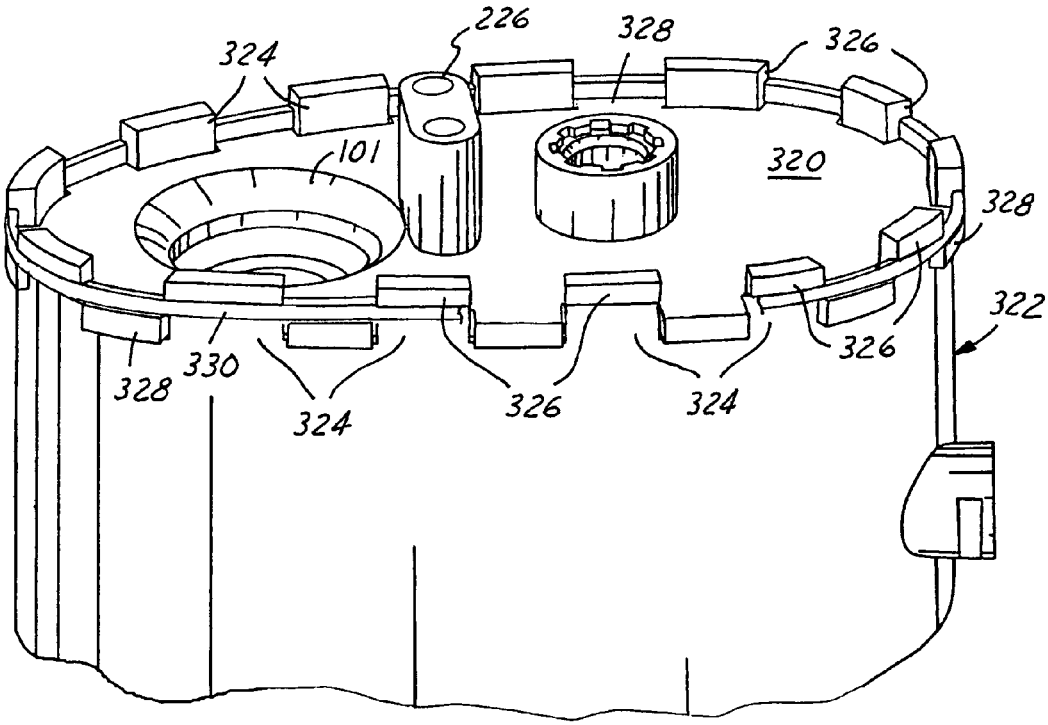
FIG. 23 is a fragmentary perspective view of an alternate embodiment of a fuel vapor separator including a main body and lid including interlocked fingers.

FIG. 23 illustrates modified forms of a lid 320 and main body 322 to facilitate retaining the lid 320 on the main body 322. In this embodiment, the main body 322 has circumferentially spaced apart upstanding fingers 324 with outwardly extending flanges 326 on each finger 324. The lid 320 has corresponding outwardly extending tabs 328, with each tab 328 adapted to be disposed between a pair of adjacent fingers 324 on the main body 322. A wire or circumferential band 330 can be looped about the exterior of the fingers 324 so that it is received between the flanges 326 and tabs 328 to prevent movement of the lid 320 relative to the main body 322. The wire or band 330 may be circumferentially continuous and installed by a snap fit, or it may have a pair of separate or spaced apart ends and be formed with a sufficiently resilient material so that it is maintained between the lid 320 and main body 322, or the ends may be fastened together, for example. The retainer 330 could also be a garter spring, a cable tie, a ratcheting nylon strap, or an O-ring, by way of additional examples, without limitation. This interconnection between the lid 320 and main body 322 may provide a relatively even distribution of the forces around the circumference of the main body 322 and lid 320, and may help prevent radially outward flexing of the main body 322 to maintain a fluid-tight seal between the lid 320 and main body 322.

Figure 24:
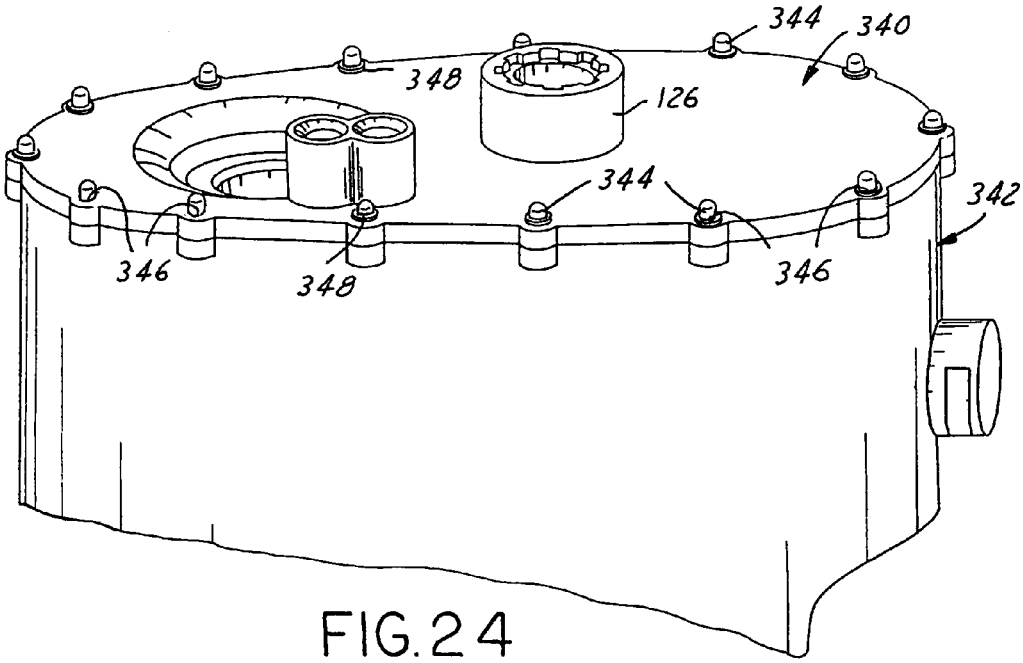
FIG. 24 is a fragmentary perspective view of another alternate embodiment fuel vapor separator including another arrangement of a lid and main body.

FIG. 24 illustrates another alternate embodiment of a lid 340 and main body 342 including a plurality of upstanding posts 344 extending from the main body 342 and received through aligned complementary holes 346 in the lid 340. A retainer 348, such as a tinnerman-style retainer can be pushed over the posts 344 to retain the lid 340 on the main body 342. The retainer 348 may be individual for each post 344, or multiple retainers 348 that each engage more than one post 344, or a single retainer 348 can be provided which engages each post 344 and retains the lid 340 on the main body 342. Of course, the lid 340 could be connected to the main body 342 without any retainer 348, such as by welding or bonding, or by deforming the posts 344 such as by heat staking and the like.

Figure 25:
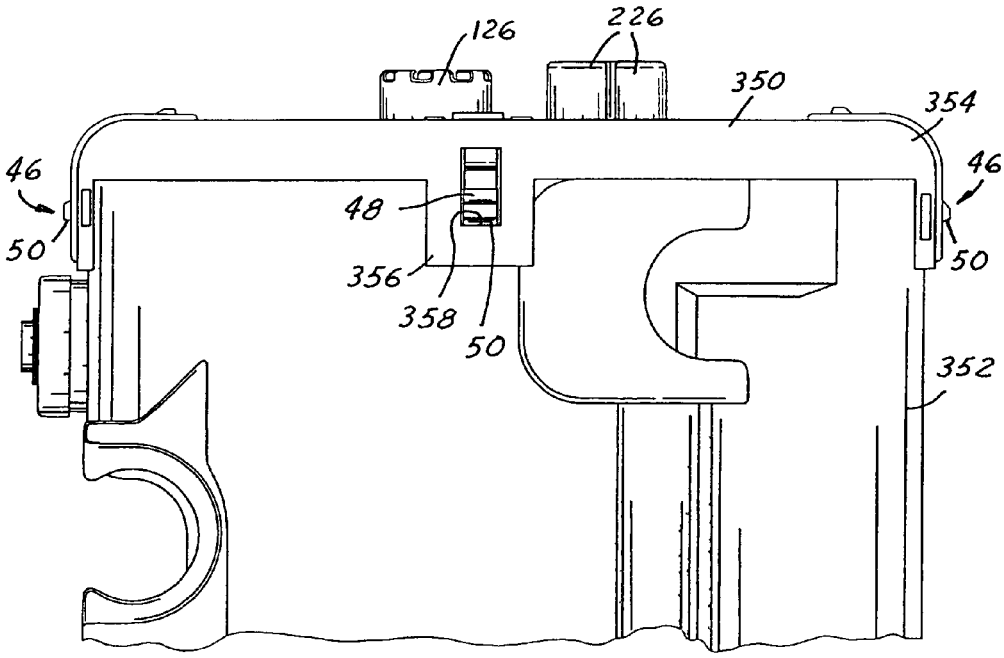
FIG. 25 is a fragmentary side view of another alternate embodiment fuel vapor separator illustrating another arrangement of a lid and main body.

FIG. 25 illustrates yet another embodiment of a lid 350 and main body 352 designed to facilitate attachment to and retention of the lid 350 on the main body 352. In this embodiment, a circumferentially continuous retainer 354 overlies a portion of the lid 350 and includes a plurality of depending flanges 356 having catches 358 adapted to engage latches 46 on the main body 352. The latches 46 may be designed as described with reference to the first embodiment full vapor separator 10. Hence, a circumferentially continuous retainer 354 is provided that engages the lid 350 substantially continuously along its periphery, and engages the main body 352 at multiple points, namely the catches 50 or latches 46 on the main body 352.

Figure 26:
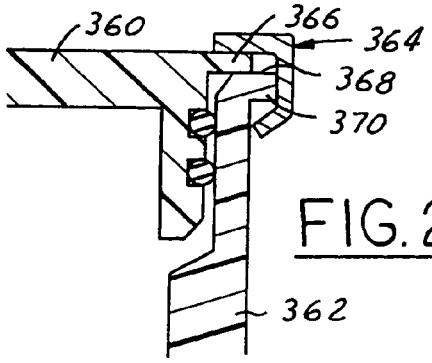
FIG. 26 is a fragmentary sectional view illustrating an alternate arrangement of a lid, main body and retainer securing the lid to the main body.

FIG. 26 shows yet another embodiment of a lid 360, main body 362 and retainer 364. In this embodiment, the lid 360 includes an outwardly extending flange 366 that overlies an upper rim 368 of the main body 362. The upper rim 368 of the main body 362 preferably includes a radially outwardly extending lip 370. The retainer 364 is fixed to the lid 360 and main body 362 so that the flange 366 on the lid 360 is trapped between the retainer 364 and the rim 368 of the main body 362. The retainer 364 is received over the outwardly extending lip 370 on the main body 362 to prevent the lid 360 from lifting off of the main body 362. The retainer 364 may be crimped or otherwise formed over the lip 370 on the main body 362, or received in a groove of the main body, by way of examples without limitation. The circumferential retainer 364, in addition to retaining the lid 360 on the main body 362, prevents radial deflection of the upper end of the main body 362 and thereby improves the reliability of the seal between the lid 360 and main body 362.

Figure 27:
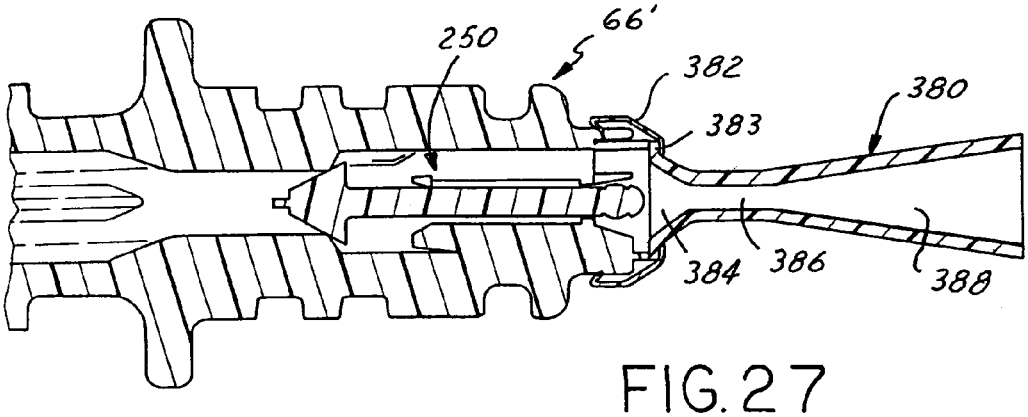
FIG. 27 is a fragmentary sectional view of an inlet fitting including a check valve and a venturi tube.

FIG. 27 illustrates an alternate embodiment of a return inlet fitting 66' that includes a venturi tube 380 carried by the fitting 66' downstream of the inlet check valve 250. The venturi tube 380 is preferably fixed to the inlet fitting 66' by a retainer 382 which traps a radially outwardly extending flange 383 of the venturi tube 380 against an end of the inlet fitting 66'. The venturi tube 380 includes an inlet section 384, a necked down venturi section 386 and diverging outlet section 388. Return fuel is directed into the venturi tube 380 at relatively high velocity when the check valve 250 is open, and the venturi tube 380 is designed to slow the velocity of the fuel to provide essentially laminar flow of fuel through the return inlet fitting 66' and into the main fuel chamber 32, rather than fuel being sprayed or ejected at high velocity from the inlet fitting 66'. This minimizes vapor generation and prevents the fuel from foaming or becoming overly agitated.

Preferably, a small back pressure is created upstream of the venturi tube outlet 388 to force the high velocity fuel into a fully liquid state, rather than a more turbulent liquid/vapor state. In general, since the fuel flow velocity out of the venturi tube 380 will be proportional to the flow area of the outlet 388 of the venturi tube 380, it is generally desirable to make the flow area of the outlet 388 as large as possible. In the presently preferred embodiment, the back pressure is created by the necked down or venturi section 386 of the venturi tube 380, and the reduced velocity of the fuel flow by way of an enlarged outlet is provided by the diverging outlet 388 section of the venturi tube 380. Accordingly, the desired fuel flow characteristics can be achieved with a relatively short venturi tube 380 which improves packaging, handling and assembly.

What is claimed is:

1. A fuel vapor separator, comprising:

a main body formed of a polymeric material and defining at least part of one chamber in which fuel is received;

a lid securable to the main body with a liquid tight seal between them;

a vapor vent valve carried by one of the main body and the lid, the vapor vent valve being in communication with said at least one chamber and having an outlet through which fuel vapor may be vented from the chamber; and a heat exchanger including a tube disposed at least partially in said at least one chamber for external contact with liquid fuel in said at least one chamber and having an inlet in communication with a supply of coolant and an outlet through which coolant leaves the tube.

2. The fuel vapor separator of claim 1 wherein the lid is formed from a polymeric material.

3. The fuel vapor separator of claim 1 which also includes a heat exchanger defining at least one coolant passage operably communicated with said one chamber to cool fuel in said one chamber.

4. The fuel vapor separator of claim 1 wherein the tube is coiled in the chamber.

5. The fuel vapor separator of claim 1 wherein the tube is formed from a non-ferrous metal.

6. The fuel vapor separator of claim 4 which also includes a support carried by the main body and disposed adjacent to at least one coil of the tube to support the tube.

7. The fuel vapor separator of claim 1 which also includes a retainer disposed adjacent to the lid and main body to secure the lid to the main body.

8. The fuel vapor separator of claim 1 which also includes a seal disposed between the lid and the main body to provide a fluid tight seal between the lid and main body.

9. The fuel vapor separator of claim 7 wherein the lid includes at least one latch surface and the main body includes at least one latch surface, and the retainer has at least two tabs with at least one tab adapted to engage the latch surface on the lid and at least one other tab adapted to engage the latch surface on the main body to secure the lid to the main body.

10. The fuel vapor separator of claim 9 wherein each latch surface includes an inclined ramp surface and a catch so that the corresponding tabs on the retainer slide over the ramp surface and are tightly received against the catch in assembly.

11. The fuel vapor separator of claim 9 wherein the retainer is symmetrical so that the tabs may each engage either of the catches on the lid and the main body.

12. The fuel vapor separator of claim 7 which also comprises a catch on the main body and wherein the retainer is attached to the lid and adapted to engage the catch when the lid is received on the main body to secure the lid to the main body.

13. The fuel vapor separator of claim 7 which also comprises a catch on the lid and wherein the retainer is attached to the main body and adapted to engage the catch when the lid is received on the main body to secure the lid to the main body.

14. The fuel vapor separator of claim 7 which also comprises fingers carried by the lid and fingers carried by the main body with the fingers of the lid disposed adjacent to at least one finger on the main body, and wherein the retainer is coupled to the fingers of at least one of the lid and the main body to secure the lid to the main body.

15. The fuel vapor separator of claim 14 wherein each finger of the lid is disposed between two adjacent fingers of the main body.

16. The fuel vapor separator of clam 14 wherein a groove is defined between the fingers of the lid and the fingers of the main body and said retainer is disposed in said groove.

17. The fuel vapor separator of claim 1 which also includes a finger carried by the main body and an opening in the lid, the finger being received through the opening when the lid is received on the main body.

18. The fuel vapor separator of claim 17 which also includes a retainer disposed on the finger to retain the lid on the main body.

19. The fuel vapor separator of claim 17 wherein the finger is welded to the lid.

20. The fuel vapor separator of claim 7 wherein the retainer circumscribes the perimeter of the lid and engages the main body in at least two spaced apart locations to secure the lid to the main body.

21. The fuel vapor separator of claim 20 wherein the retainer includes a plurality of latches and the main body includes a plurality of catches with each latch engaging a separate catch when the retainer is installed to secure the lid to the main body.

22. The fuel vapor separator of claim 7 wherein the main body includes a shoulder disposed adjacent to the lid in assembly of the lid on the main body, and the retainer is deformed at least partially around the shoulder in assembly to secure the lid to the main body.

23. The fuel vapor separator of claim 6 wherein the support includes at least one finger that is resilient and engaged with the coil.

24. The fuel vapor separator of claim 23 wherein said at least one finger includes a catch that prevents lateral movement of the coil in the direction of the catch.

25. The fuel vapor separator of claim 1 which also includes an interior wall of the main body that defines at least in part a second chamber in the main body, and a fuel pump received in the second chamber and having an inlet in communication with said one chamber of the main body and an outlet through which pressurized fuel is discharged.

26. The fuel vapor separator of claim 25 which also includes a pair of seals disposed between the fuel pump and the fuel vapor separator to define a coolant chamber surrounding at least a portion of the fuel pump.

27. The fuel vapor separator of claim 26 wherein the main body includes a coolant inlet through which coolant is routed to the coolant chamber and a coolant outlet from which coolant is removed from the coolant chamber.

28. The fuel vapor separator of claim 1 wherein the main body includes a plurality of upstanding fingers spaced from an interior surface of the main body and the lid includes a depending rim received between said fingers and said interior surface of the main body in assembly to locate the lid relative to the main body.

29. The fuel vapor separator of claim 1 wherein the vent valve includes at least one opening and the lid includes a plurality of posts with each post capable of being received in said at least one opening permitting the vent valve to be mounted in more than one orientation relative to the lid.

30. The fuel vapor separator of claim 1 wherein the vent valve includes a pair of flanges with aligned openings, a pair of flexible and resilient legs with one disposed adjacent to each of the flanges, a pivot pin received in the openings with each leg bent and loaded against the pivot pin, and a float operably associated with the pivot pin for pivotal movement in response to the level of liquid fuel in the fuel vapor separator.

31. The fuel vapor separator of claim 30 which also includes a float arm connected to the float and rotatably connected to the pivot pin to permit pivotal movement of the float arm and float relative to the flanges, a vent bore adjacent to the float arm and a vent valve body movable relative to the vent bore in response to movement of the float arm as the float moves in response to changes in the liquid fuel level in the fuel vapor separator to selectively close the vent bore.

32. The fuel vapor separator of claim 31 wherein the float arm includes a slot and the vent valve includes a clip interconnecting the vent valve body and the float arm.

33. The fuel vapor separator of claim 32 which also includes a spring disposed between the float arm and the vent valve body.

34. The fuel vapor separator of claim 31 wherein the vent bore is formed through a main wall of the vent valve and the main wall is sloped toward the vent bore.

35. The fuel vapor separator of claim 34 which also includes a post extending from the main wall and a fitting disposed on the post through which fuel vapor that passes through the vent valve is carried away from the fuel vapor separator.

36. The fuel vapor separator of claim 35 wherein the post has at least one recess therethrough defining a gap between the post and the fitting so that fuel vapor may pass between the post and fitting.

37. The fuel vapor separator of claim 1 which also includes a return fuel inlet in the main body through which fuel enters said one chamber, and a baffle adjacent to the return fuel inlet to control the travel of fuel discharged into the main body through the return fuel inlet.

38. The fuel vapor separator of claim 35 wherein the fitting is received through an opening in the lid and has at least one flexible leg that is flexed inwardly when the fitting is pressed into said opening, and said post is received in assembly adjacent to said flexible leg to prevent inward deflection of the leg to thereby retain the fitting in the opening.

39. The fuel vapor separator of claim 37 wherein the return fuel inlet includes a diverging outlet to reduce the velocity of fuel flowing therethrough.

40. The fuel vapor separator of claim 37 which also includes a venturi tube aligned with the return fuel inlet so that fuel flowing through the return fuel inlet also flows through the venturi tube prior to entering said one chamber, and the venturi tube includes a necked down portion and a diverging outlet to control the flow of fuel therethrough.

41. The fuel vapor separator of claim 1 which also includes a coolant inlet and a coolant outlet formed in the main body with the inlet and outlet of the heat exchanger tube being received in the coolant inlet and coolant outlet, respectively.

42. The fuel vapor separator of claim 1 which also includes a pressure relief valve carried by one of the lid and the main body and having a valve opening and a valve head adapted to close the valve opening until a threshold pressure is reached within said one chamber.

43. The fuel vapor separator of claim 42 wherein the vent valve and pressure relief valve are carried by the lid.

44. The fuel vapor separator of claim 42 wherein the vent valve and pressure relief valve are carried by a housing that is carried by the lid.

45. A fuel vapor separator, comprising:

a main body formed of a polymeric material and defining at least part of one chamber in which fuel is received;

a lid securable to the main body with a liquid tight seal between them;

at least one retainer securing the lid to the main body;

a vapor vent valve carried by one of the main body and the lid, the vapor vent valve being in communication with said at least one chamber and having an outlet through which fuel vapor may be vented from the chamber;

a fuel pump at least partially received in the main body, having an inlet in communication with said one chamber, and an outlet through which pressurized fuel is delivered; and a heat exchanger disposed at least in part in said one chamber so that at least a portion of the heat exchanger is externally surrounded by liquid fuel in said one chamber to cool liquid fuel in said one chamber.

46. The fuel vapor separator of claim 45 wherein the lid is formed from a polymeric material.

47. The fuel vapor separator of claim 45 wherein the lid includes at least one latch surface and the main body includes at least one latch surface, and the retainer has at least two tabs with at least one tab adapted to engage the latch surface on the lid and at least one other tab adapted to engage the latch surface on the main body to secure the lid to the main body.

48. The fuel vapor separator of claim 45 wherein the retainer circumscribes the perimeter of the lid and engages the main body in at least two locations to secure the lid to the main body.

49. The fuel vapor separator of claim 48 wherein the retainer includes a plurality of latches and the main body includes a plurality of catches with each latch engaging a separate catch when the retainer is installed to secure the lid to the main body.

50. The fuel vapor separator of claim 48 wherein the retainer engages the main body about substantially its entire perimeter.

51. The fuel vapor separator of claim 45 which also includes a pair of seals disposed between the fuel pump and the main body to define a coolant chamber surrounding at least a portion of the fuel pump.

52. A vapor vent valve for venting fuel vapors from a supply of liquid fuel, comprising:

a main body with a vent bore and a valve seat surrounding the vent bore, a pair of flanges having aligned openings, and a pair of flexible legs spaced from the flanges;

a pivot pin received through the aligned openings in the flanges and engaged by the legs to retain the pivot pin in the aligned openings;

a float arm carried by the pivot pin for pivoted movement relative to the flanges;

a float carried by the float arm to move the float arm in response to changes in the level of fuel in the supply of liquid fuel; and a valve body operably associated with the float arm for movement with the float arm during at least a portion of the movement of the float and engagable with the valve seat to close the vent bore when the level of fuel in the supply of liquid fuel reaches a maximum level to inhibit the flow of liquid fuel through the vent bore.

53. The valve of claim 52 which also includes a clip interconnecting the vent valve body and the float arm.

54. The valve of claim 53 which also includes a spring disposed between the clip and the vent valve body.

55. The valve of claim 52 wherein the main body includes a main wall, the vent bore is formed through the main wall, and the main wall is sloped toward the vent bore so that any liquid fuel that flows through the vent bore can be drained back through the vent bore and into the supply of liquid fuel.

56. The fuel vapor separator of claim 55 which also includes a post extending from the main wall and a fitting disposed on the post through which fuel vapor that passes through the vent valve is carried away from the fuel vapor separator.

57. The fuel vapor separator of claim 56 wherein the post has at least one recess therethrough defining a gap between the post and the fitting so that fuel vapor may pass between the post and fitting.

* * * * *